US006705789B2

(12) United States Patent
Maruyama et al.

(10) Patent No.: US 6,705,789 B2
(45) Date of Patent: Mar. 16, 2004

(54) MECHANICAL PENCIL

(75) Inventors: Shigeki Maruyama, Tokyo (JP); Toshiro Henmi, Tokyo (JP); Tsukasa Sasaki, Tokyo (JP)

(73) Assignee: Pentel Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/937,984

(22) PCT Filed: Mar. 28, 2001

(86) PCT No.: PCT/JP01/02544

§ 371 (c)(1),
(2), (4) Date: Oct. 3, 2001

(87) PCT Pub. No.: WO01/74603

PCT Pub. Date: Oct. 11, 2001

(65) Prior Publication Data

US 2002/0154934 A1 Oct. 24, 2002

(30) Foreign Application Priority Data

| | | |
|---|---|---|
| Mar. 30, 2000 | (JP) | 2000-95124 |
| Apr. 28, 2000 | (JP) | 2000-129164 |
| May 31, 2000 | (JP) | 2000-161347 |
| Jun. 26, 2000 | (JP) | 2000-190932 |
| Jul. 27, 2000 | (JP) | 2000-227844 |
| Nov. 21, 2000 | (JP) | 2000-354336 |
| Nov. 29, 2000 | (JP) | 2000-363822 |
| Jan. 31, 2001 | (JP) | 2001-22541 |

(51) Int. Cl.[7] ..... B43K 21/22
(52) U.S. Cl. ..... 401/93; 401/86; 401/67
(58) Field of Search ..... 401/93, 92, 86, 401/85, 82, 67, 65, 55

(56) References Cited

U.S. PATENT DOCUMENTS

| | | | | | |
|---|---|---|---|---|---|
| 4,264,227 | A | * | 4/1981 | Iwasaki | 401/94 |
| 4,911,569 | A | * | 3/1990 | Hashimoto et al. | 401/55 |
| 4,969,763 | A | * | 11/1990 | Kageyama et al. | 401/68 |
| 6,334,728 | B1 | * | 1/2002 | Suzuki | 401/67 |
| 6,379,067 | B2 | * | 4/2002 | Kageyama et al. | 401/94 |
| 6,382,859 | B2 | * | 5/2002 | Noguchi et al. | 401/92 |
| 6,517,272 | B1 | * | 2/2003 | Kageyama et al. | 401/92 |

FOREIGN PATENT DOCUMENTS

| | | |
|---|---|---|
| JP | 52126936 | 9/1977 |
| JP | 57009101 | 2/1982 |
| JP | 02530088 | 11/1991 |

* cited by examiner

*Primary Examiner*—Gregory Huson
*Assistant Examiner*—Huyen Le
(74) *Attorney, Agent, or Firm*—Adams & Wilks

(57) ABSTRACT

A mechanical pencil has a tubular member having a front end and a rear end. A slide member is disposed at the front end of the tubular member for axial sliding movement therein. The slide member has a lead passageway for receiving a pencil lead. A lead advancement mechanism undergoes axial movement within the tubular member and has a chuck body for undergoing advancing movement to advance the pencil lead through the lead passageway of the slide member and toward the front end of the tubular member and for undergoing retracting movement toward the rear end of the tubular member. The slide member is disposed in frictional engagement with the chuck body for retracting movement therewith.

18 Claims, 27 Drawing Sheets

MECHANICAL PENCIL

BACKGROUND OF THE INVENTION

1. Field of the Invention

The present invention relates to a mechanical pencil in which a tubular shaft has at its front portion a slide member having a passage for a writing lead, and a lead advancement means axially slidably disposed in the tubular shaft.

2. Background Information

An example of the mechanical pencil of the type described which is shown in Japanese Pre-examined Utility Model Publication No. 56-44191 has a tubular shaft and an axially movable lead tank in the tubular shaft, and a chuck body is fixedly provided in front of the lead tank for the purpose of advancing the writing lead in the forward direction. At a front portion of the chuck body, a chuck ring is positioned around the chuck body to open/close the chuck body.

Further, a front member is fixed to the front end portion of the tubular shaft, and the front member has a passage for permitting the lead to move therethrough and, in addition, a slide member to which an anti-retraction member for the lead is press-fitted is arranged so that the slide member can project from an end of the front member.

In the known structure of the mechanical pencil described above, there is generally produced a gap or space between a rear end of a shortened residual lead (hereinafter referred to as a "remaining lead") which has been positioned out of the chuck body and a front end of a succeeding (or, following) new lead (hereinafter referred to as a "succeeding lead"). This is caused by the following mechanism. Namely, the chuck body is closed by a chuck ring immediately before a retracting movement of the chuck body ends and is retracted grasping the succeeding lead. At this moment, however, the shortened remaining lead is positioned independent of the succeeding new lead and slightly held by the anti-retraction member in the front member so that the shortened lead is prevented from being retracted.

Once a gap as the gap described is produced, the remaining lead is retracted unexpectedly by a writing pressure in a writing operation and this results in a failure of writing and consequently a growth of feeling of wrongness.

Further, some users who dislike the above phenomena try to remove the remaining lead out of a lead guide member and operate to advance the next new lead. This will be a burden to an effective use of the shortened remaining leads.

SUMMARY OF THE INVENTION

In view of the above, it is an object of the present invention to provide a mechanical pencil which can abolish the disadvantages and difficulties appearing in the conventional structure described above and permits an effective use of the remaining leads.

According to a first aspect of the present invention, there is provided a mechanical pencil which comprises a tubular shaft having at its front portion a slide member having a passage for a writing lead, and a lead advancement means axially slidably disposed in the tubular shaft, wherein the slide member and at least one element of the lead advancement means are co-acted and interlocked with each other.

According to a second aspect of the invention, there is provided a mechanical pencil comprising a first chuck body at the rear portion of a second chuck body, the second chuck body grasping lead and releasing the same, the second chuck body having an anti-retraction member for softly holds the lead, wherein the first chuck body and the second chuck body are co-acted (interlocked) in the retraction movement thereof such that the retraction movement is conducted by a retraction of the first chuck body.

According to a third aspect of the invention, a slide member having a lead passage is disposed at a front portion of the tubular shaft, and a lead advancement (feeding) means is axially moveably disposed in the tubular shaft, wherein a knocking actuator member is provided to have a contact portion such that the contact portion is contacted with the slide member and the lead advancement (feed) member.

According to a fourth aspect of the invention, a slide member having a lead passage is disposed at a front portion of the tubular shaft and a lead advancement (feeding) means is axially moveably disposed in the tubular shaft, wherein the slide member is retracted by pushing a part of the tubular shaft.

In the structure of the mechanical pencil according to the invention, when the slider is retracted, a remaining (residual) lead is retracted with contacting with a succeeding lead.

BRIEF DESCRIPTION OF THE DRAWINGS

FIGS. 87 to 89 show a structure according to a twenty-first embodiment of the invention, wherein FIG. 87 is an enlarged sectional view, FIG. 88 a transversal sectional view, and FIG. 89 is a diagram explaining the operational mode.

DETAILED DESCRIPTION OF THE PREFERRED EMBODIMENTS

Figure 1:
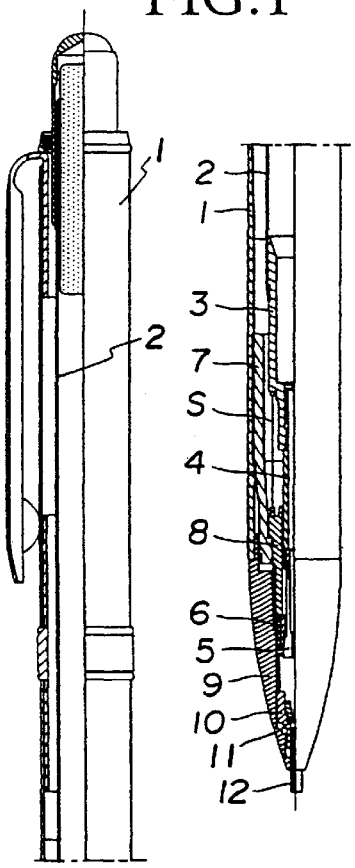
FIG. 1 is a longitudinal sectional view of a part of a mechanical pencil according to a first embodiment of the invention.

A first embodiment of the invention will be described with reference to FIGS. 1 and 2. A tubular shaft 1 has a lead tank 2 which is moveable axially (or, in the frontward/backward direction) in the tubular shaft, and the lead tank 2 has at its front end a chuck body 5 which is fixed thereto and can be opened through an intermediate joint member 3 and a lead guide member 4. The chuck body has, around its front portion, a chuck ring 6 which serves to open/close the chuck body 5.

On the front end of the tubular shaft 1 is provided a front member 9 which is releasably engaged with the front end through a press member 7 and a connecting member by a threaded engagement means or the like. The front member 9 can be formed integral with the tubular shaft 1. A slide member 10 is axially moveably disposed in the front member 9 and has an anti-retraction member 11 which is made of a suitable rubber material and press-fitted in the slide member 10 for providing a light and soft holding of a writing lead to prevent the lead from retracting. Reference numeral 12 denotes a lead protection tube of a metal which is press-fitted to a front end of the slide member 10, and the lead protection tube 12 can be made integral with the slide member 10.

Figure 2:
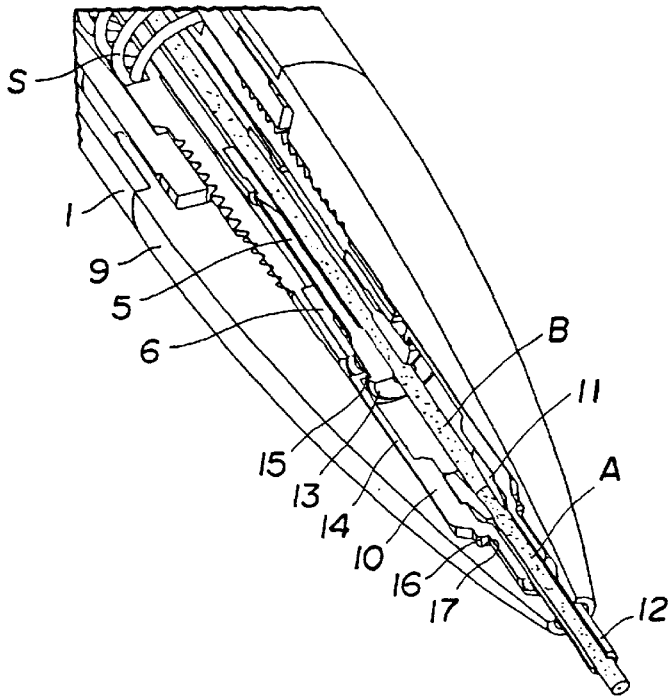
FIG. 2 is an enlarged perspective view of a part of the pencil shown in FIG. 1.

In the illustration of FIG. 1, reference character "S" represents a resilient member such as a coil spring for biasing the chuck body 5 as well as the lead tank 2 in a backward direction. The tubular shaft 1 is made of a transparent material and similarly the other elements such as the slide member 10 and the anti-retraction member 11 can be made of a transparent material so that actuation and movement of the writing lead can be visually observed by a user.

The chuck body 5 and the slide member 10 will be explained. On a front outer portion of the chuck body 5 is provided an outer flange portion 13. At the rear portion of the slide member 10 is provided a tubular portion 14 which extends from the rear portion and has an inner flange portion 15 which contacts the outer flange portion 13 of the chuck body 5.

The chuck body 5 is of so-called collet-type having two-split, three-split or four-split chuck leaves and has a structure that when it is firmly closed with no lead being held therein, the outer flange portion 13 of the chuck body 5 is released from the inner flange portion 15 of the slide member 10. In other words, the chuck body 5 and the slide member 10 are separable from each other and can be assembled when necessary.

The slide member 10 is movably inserted into the front member 9 but a friction force (i.e., resistance) can be added between the elements 9 and 10 so that a soft engagement is established. However, it is noted that the friction force is set smaller than a friction force of the anti-retraction member 11 relative to the writing lead. By preventing the slide member 10 from moving while the lead is not grasped, generation of a moving sound of the slide member 10 can be prevented, wherein the moving sound is a noise which is likely to be produced when a middle step portion of the slide member 10 abuts against an inner step of the front member 9 and is produced when the pencil is shaken.

On the inner front portion of the front member 9, there is provided an inner step portion 17 to which a front end 16 of the slide member 10 is contacted to limit an advance distance of the slide member 10.

An operation will now be described. FIG. 2 shows a state in which a shortened residual lead A left from the chuck body 5 is held by the anti-retraction member 11 and a succeeding lead B is being held by the chuck body 5. When the lead tank 2 is pressed forward in this state, the chuck body 5 is advanced along with the chuck ring 6, so that the succeeding lead B is also advanced together. Then, along with the advance of the succeeding lead B, the residual lead A is pushed forward but, in this state, the residual lead A is held by the anti-retraction member 11 and, consequently, the slide member 10 is advanced together with the residual lead A. In this state, when the middle step portion 16 of the slide member 10 is contacted with the inner step portion 17 of the front member 9, this restricts an advancing movement of the slide member 10. By the operation described, the lead protection tube 12 fixed to the slide member 10 is advanced relative to the front member 9 and, therefore, a projection length of the lead protection tube 12 projecting from the front member 9 becomes larger than a length of an initial position.

When the lead tank 2 is advanced further, the residual lead A is pushed forward by the succeeding lead B and advanced in the lead protection tube 12 which is prevented from moving so that the succeeding lead B is projected from the end of the lead protection tube 12. In a short time, the chuck ring 6 comes into contact with a rear end of the slide member 10 and limited its further advancing movement, so that the chuck body is released to open its engagement (grasping) portion to thereby release the succeeding lead B.

In this state, when the advancing movement of the lead tank 2 is released, the chuck body 5 is retracted with the succeeding lead B being released. During this retraction of the chuck body 5, the outer flange 13 of the chuck body 5 is contacted with the inner flange 15 of the slide member 10 so that the slide member 10 as well is retracted. At this moment, the residual lead A is softly held by the anti-retraction member 11 of the slide member 10 and, therefore, it is retracted together with the slide member 10 with its projecting state being maintained, and this serves to retract the succeeding lead B which has been released from the chuck body 5.

Then, the chuck body 5 is closed by the chuck ring 6 to grasp and retract the succeeding lead B, but since the residual lead A is retracted together with the slide member 10 as described above, no gap or space is generated between the residual lead A and the succeeding lead B.

Although the residual lead A is retracted by the operation described above, it is retracted together with the slide member 10 relative to the front member 9 and, therefore, the residual lead A does not retract relative to the lead protection tube 12 (slide member 10). As a result, a projecting length of the residual lead A from the lead protection tube 12 is not decreased but maintained.

Figure 3:
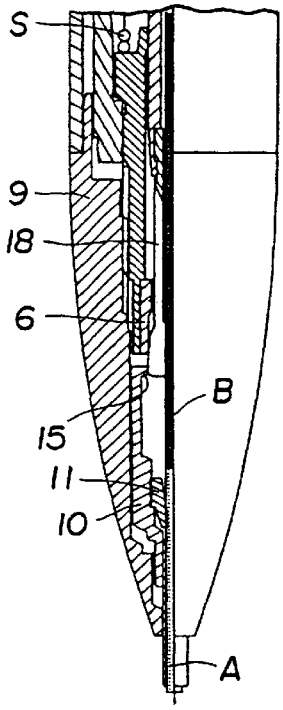
FIG. 3 is a longitudinally sectional view of a part of a mechanical pencil according to a second embodiment of the invention.

A second embodiment of the invention will be described with reference to FIGS. 3 to 5. This is a modification of an interlocking mechanism of the chuck body and the slide member in the first embodiment described above. In this embodiment, a chuck body 18 does not have a portion like the flange portion 13 of the first embodiment but, instead, it has a structure that a frictional resistance is added to the inner flange 15 of the slide member 10. As an example of providing such a frictional resistance to the inner flange 15, an outer diameter of the front outer circumference of the chuck body 18 is made slightly larger than an inner diameter of the inner flange portion 15 of the slide member 10 and, in another alternative, a resilient material such as rubber can be coated on at least one of the contacted portions. Alternatively, embossing or graining can be used.

An operation will be explained. In an initial stage of operation wherein the chuck body 18 is gasping the lead (see FIG. 3), the chuck body 18 contacts at its front outer circumference to an inside of the inner flange portion 15 of the slide member 10. At this moment, when the chuck body 18 is advanced together with the chuck ring 6, the slide member 10 as well is advanced because the chuck body 18 and the inner flange portion 15 are frictionally engaged with each other. It is a matter of course that the residual lead A grasped by the anti-retraction member 11 and the succeeding lead B held by the chuck body 18 are advanced as well.

Figure 4:
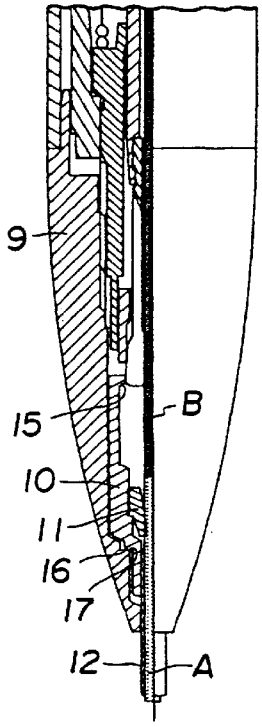
FIGS. 4 and 5 show an operation of the mechanical pencil of the second embodiment.

Further, when the chuck body 18 and the slide member 10 are advanced, the middle step 16 of the slide member 10 is contacted with the inner step portion 17 of the front member 9 similarly as the case of the first embodiment, and the forward movement of the slider member 10 is prevented (see FIG. 4). However, the chuck body 18 can be advanced further, and a contact between the chuck body 18 and the inner flange 15 of the slide member 10 is released against the frictional force. Since the chuck body is further advanced, the residual lead A is advanced in the lead protection tube 12.

Figure 5:
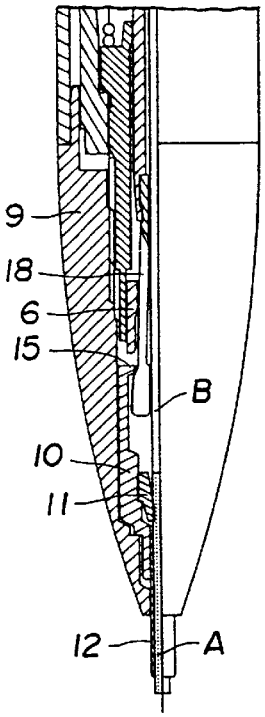

Then, the chuck ring 6 is contacted with the rear end of the slide member 10 and the chuck body 18 is opened to release the succeeding lead B as shown in FIG. 5. Now, when the advancing movement of the chuck body 18 is released, the chuck body 18 is retracted by the resilient member "S", the front outer circumference of the chuck body 18 is again contacted with the inner flange 15 of the slider member 10, and by the frictional resistance of the contact the slide member 10 as well is retracted. By the retraction of the slide member 10, the residual lead A held by the anti-retraction member 11 is also retracted but this residual lead A serves to retract the succeeding lead B which was released from the chuck body 18.

Then, the chuck body 18 is closed by the chuck ring 6 to grasp the succeeding lead B and retract the same. In the case, since the residual lead A is retracted together with the slide member 10, no gap of space is produced between the residual lead A and the succeeding lead B.

In the second embodiment of the invention as well as the first embodiment, in the state that the chuck gasps no lead at all, an outer diameter of the front outer circumference of the chuck body becomes smaller than an inner diameter of the inner flange of the slide member, an easy assembling of the chuck body to the slide member is realized. In the case that the parts and elements are assembled by an automatic assembling machine, it is possible to make the front portion of the chuck body have a constant diameter and, therefore, a parts-feeding machine can be used effectively.

Figure 6:
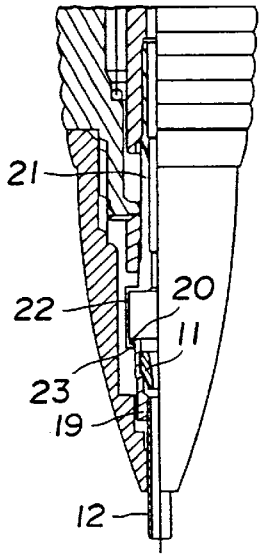
FIG. 6 is a longitudinally sectional view of a part of a mechanical pencil according to a third embodiment of the invention.

A third embodiment of the invention will be described with reference to FIG. 6, in which an outer flange portion 20 is formed on a rear outer circumference of the slide member 19 and an inner flange portion 23 is formed on the front end of the chuck body 21 through a tubular portion 22.

By making the chuck body be positioned outside the slide member, an easy assembly of these parts can be realized. Namely, in the first and second embodiment of the invention, an amount of diameter-reduction of the chuck body is restricted by a width of a slit which is formed on the chuck body. By contrast, however, in this third embodiment of the invention the chuck body is dilated outwardly and an assembly is made in this outwardly dilated state and, therefore, no restriction is required as the restriction described above.

In the third embodiment, the slide member can efficiently be retracted in the tubular portion and, therefore, the lead protection tube can be housed in the front member after use.

Figure 7:
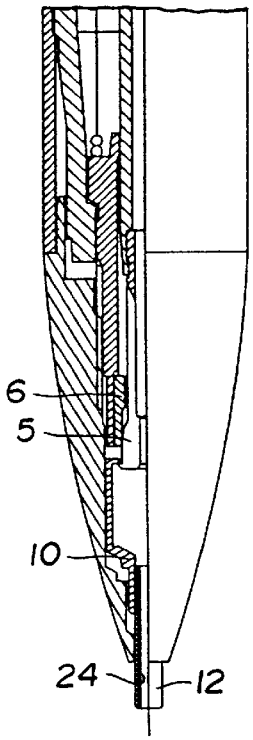
FIG. 7 is a longitudinally sectional view of a part of a mechanical pencil according to a fourth embodiment of the invention.
Figure 8:
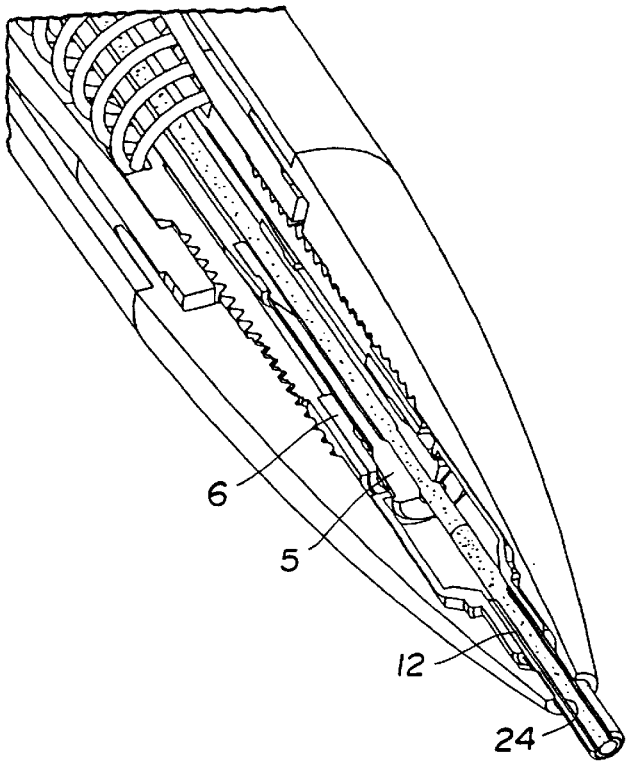
FIG. 8 is an enlarged perspective view, partly sectioned, of the structure shown in FIG. 7.

FIGS. 7 and 8 show a fourth embodiment of the invention which is substantially similar to that of the first embodiment except the anti-retraction member. Specifically, the anti-retraction member 24 in this embodiment is coated on an inner surface of the lead protection tube 12. The anti-retraction member 24 is made of a rubber-like resilient material such as silicone rubber and NBR.

The anti-retraction member 24 can be inserted into the lead protection tube. In alternatives, electroforming can be applied to provide iron ions to a surface of the anti-retraction member so that the lead protection tube 12 is formed around the anti-retraction member 24.

As described above, the anti-retraction member 24 is disposed on the lead protection tube 12 so that the lead can be held even when the residual lead becomes very short and, therefore, the lead can be used up effectively.

Figure 9:
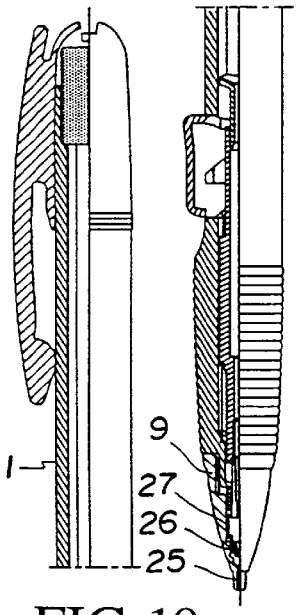
FIG. 9 is a longitudinally sectional view of a part of a mechanical pencil according to a fifth embodiment of the invention.

As a means for effectively use the residual lead A, the lead protection tube can be press-fitted into the front member 9 as shown in the four embodiment, and in another alternative, the lead protection tube 25 can be formed integral with the front member 9 (fifth embodiment shown in FIG. 9). In either cases, if the distance between the anti-retraction member 26 and the lead protection tube 12 is made short, the shortened residual lead A can still be held or grasped firmly so that the lead can be used up effectively to the very point of the minimum remaining length.

Figure 11:
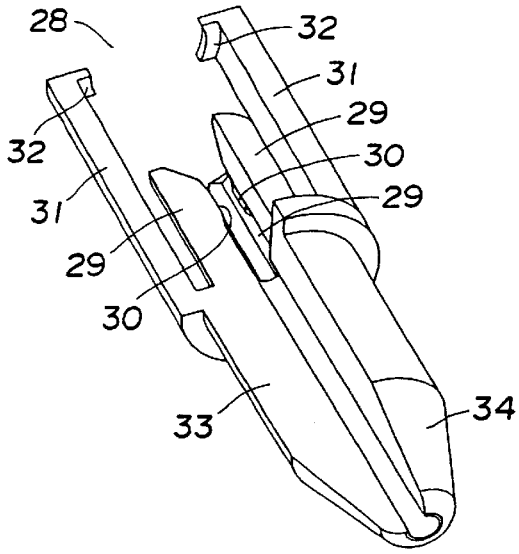
FIG. 11 is a perspective view of a slide member shown in the structure of FIG. 10.
Figure 10:
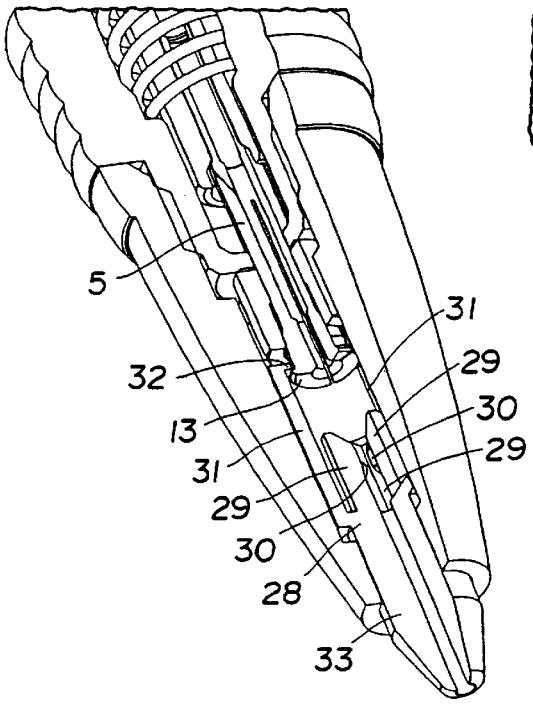
FIG. 10 is an enlarged perspective view, partly sectioned, of a part of a mechanical pencil according to a sixth embodiment of the invention.

A sixth embodiment of the invention will be described with reference to FIGS. 10 and 11. In this embodiment, the anti-retraction member and the lead protection tube are formed integral with the slide member. More specifically, anti-retraction member 29 comprised of a plurality of divided leaves is formed on an inner middle portion of the slide member 28, and a trapezoidal projection 30 for actually holding the lead is formed on the inner surface of the anti-retraction member 29. At a rear of the slide member 28, confronting engaging members 31 projecting in the rearward direction is formed and an inner flange portion 32 is formed on a rear inner surface of the engaging members 31. The inner flange portion 32 contacts the outer flange 13 of the chuck body to co-acts with the latter.

On a front portion of the slide member 28, a lead protection tube 33 is also formed in integral. On a front portion of the thus formed lead protection tube 33, a tapered portion 34 which is tapering toward a front end is formed. In writing, a tip of the writing lead can be viewed well so that a correct writing can be accomplished.

By integrally forming the anti-retraction member and the lead protection tube with the slide member, cost reduction in manufacturing parts and assembly thereof can be attained. Further, if the rear end portion of the slide member is diverged to provide split-type engagement leaves, an easy assembly operation can be made between the chuck body and the slide member.

Figure 12:
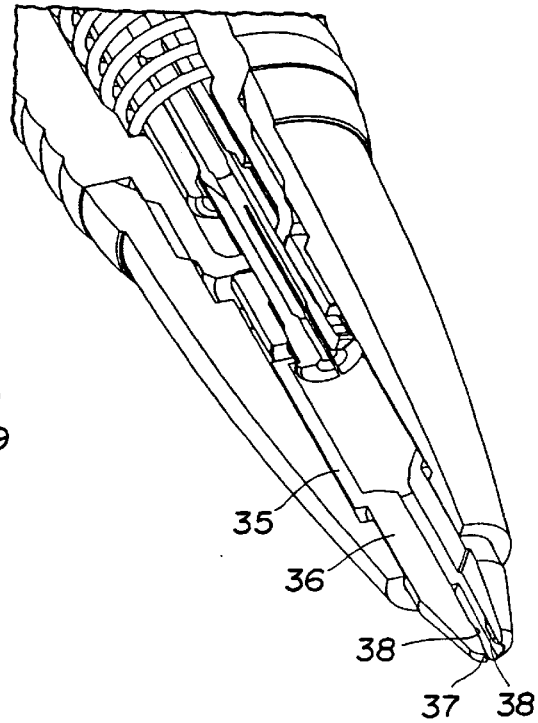
FIG. 12 is an enlarged perspective view, partly sectioned, of a part of a mechanical pencil according to a seventh embodiment of the invention.

FIG. 12 shows a seventh embodiment of the invention which is a modification of the sixth embodiment. A slit if formed on the lead protection tube 36 of the slide member 35 and a projection 38 is formed on the inner surface of the lead protection tube 36 to hold the lead. In other words, the anti-retraction member (that is, projection 38) is formed on the lead protection tube 36 and this structure permits a reliable holding of the residual lead after it is extremely shortened by use, so that a residual lead can be used up effectively to an extremity.

Figure 13:
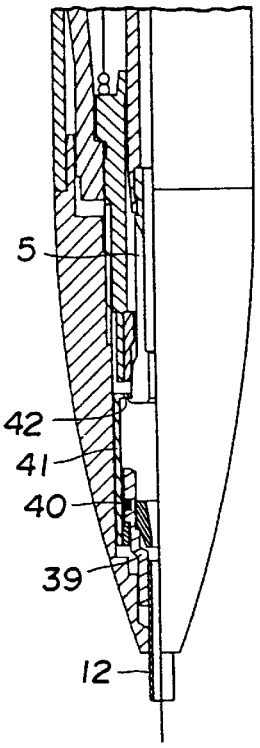
FIG. 13 is a longitudinally sectional view of a part of a mechanical pencil according to a eighth embodiment of the invention.
Figure 14:
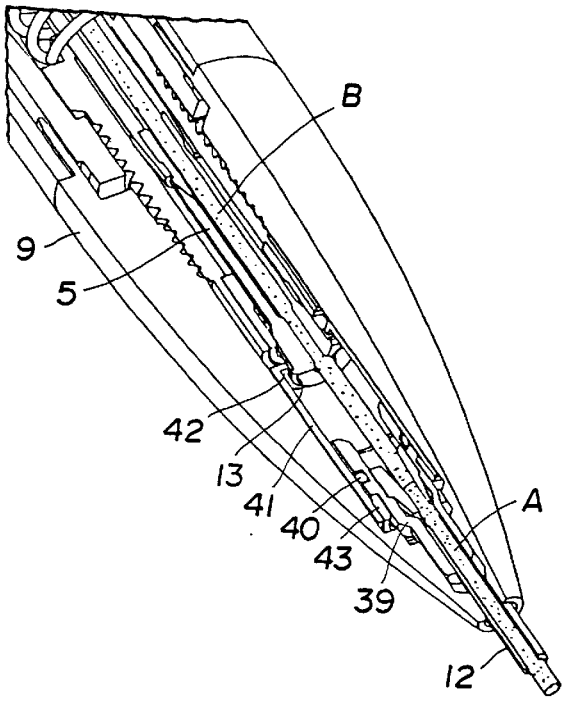
FIG. 14 is an enlarged perspective view, partly sectioned, of the structure shown in FIG. 13.

FIGS. 13 and 14 show an eighth embodiment of the invention. In this embodiment, the tubular portion of the slide member in the first embodiment is separately and independently formed relative to the slide member and these elements are frictionally engaged with each other but slidable with each other. Specifically, on the rear outer surface of the slide member 39, an O-ring 40 of a rubber-like resilient material is fitted and a tubular member 41 is fitted at a rear portion of the slide member 39. The O-ring 40 is made separate from the slide member but they are made in a unitary structure by, for example, forming circumferential rib on an outer circumference of the slide member. On an inner rear surface of the tubular member 41, an inner flange 42 is formed such that it contacts the outer flange 13 of the chuck body 5. An operational mode of this embodiment is substantially same as that of the first embodiment and, in this embodiment, if the lead protection tube 12 is contacted with a writing surface when the lead is retracted for rest after writing is finished, the lead protection tube 12 is completely encased within the front member 9. This is because the slide member to which the lead protection tube is fixed can be slid or moved in the rearward direction within the tubular member 41 against a frictional resistance of the O-ring.

Reference numeral 43 is a restriction ring which serves to prevent drop of the slide member 39 from the tubular member 41, which ring 43 can be omitted if the aforementioned O-ring has a sufficient frictional resistance force. In a case that no restriction ring 43 is provided, assembly and disassembly of the slide member and the tubular member can be made easily and an adjustment can be made easily when the tube should be blocked with the lead.

Figure 15:
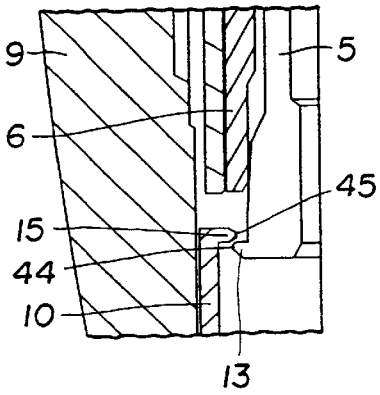
FIG. 15 is a sectional view of a part of the pencil according to a ninth embodiment of the invention.

FIG. 15 shows a ninth embodiment of the invention. On the surface of both the outer flange portion 13 of the chuck body 5 of the first embodiment and the inner flange portion 15 of the slide member 10, a male thread 44 and a female thread 45 are formed. When the chuck body 5 and the slide member 10 are assembled together, the chuck body 5 is firmly closed to fit it to the slide member 10 and, on the other hand, when they are disassemble, the chuck body is rotated relative to the slide member to release the threaded engagement between them.

Figure 16:
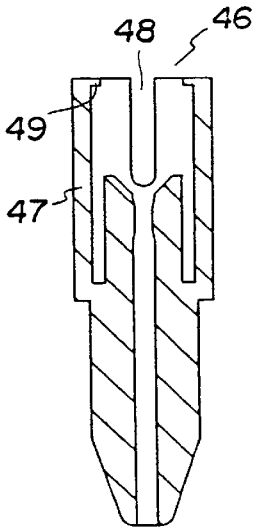
FIG. 16 is a sectional view of a slide member according to a tenth embodiment of the invention.
Figure 17:
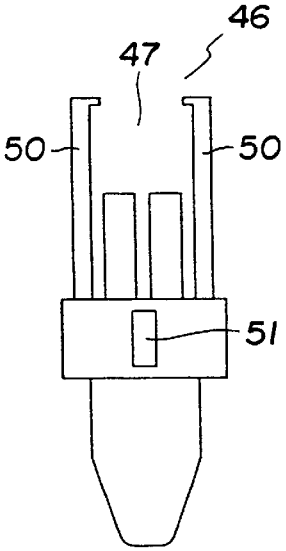
FIG. 17 is a diagram showing the slide member according to a eleventh embodiment of the invention.

FIG. 16 (tenth embodiment of the invention) and FIG. 17 (eleventh embodiment) show structures which facilitate assembly and disassembly of the chuck body and the slide member. In FIG. 16, a slit is formed at a tubular portion 47 of the slide member 46 so that the tubular portion 47 can be opened easily by the slit 48, with the result that assembly and disassembly of the chuck body relative to the slide member can be made easily. This is somewhat similar with the structure of the sixth embodiment shown in FIG. 11. In FIG. 16 reference numeral 49 represents an inner flange portion which contacts with an outer flange of the chuck body.

Further, in the embodiment of FIG. 17, the slit 48 is formed larger than that of FIG. 16 so that the aforementioned tubular portion is formed into bar-shaped structure having arms 50 with a recess 51 being formed at a middle of the slide member 46, and a longitudinal groove is formed on an inner surface of the front member 9 so that it is engaged with the recess 51. When the front member 9 is released from the tubular shaft 1, the slide member is urged to be released from the front member 9 along with the chuck body, but actually, the slide member 46 which is engaged with the front member 9 is not fully released from the front member 9 and, as a result, the arms 50 of the slide member 46 are dilated or opened. Consequently, the slide member is released from the chuck body. This will facilitates maintenance working when the writing lead should be broken in pieces in the slide member.

Figure 18:
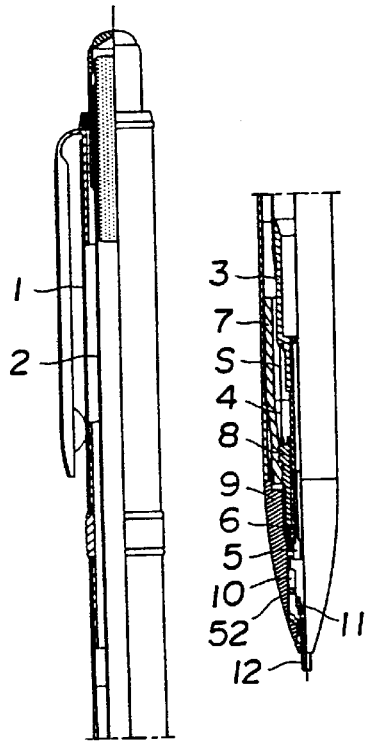
FIG. 18 is a longitudinally sectional view of a mechanical pencil to according to a twelfth embodiment of the invention.
Figure 19:
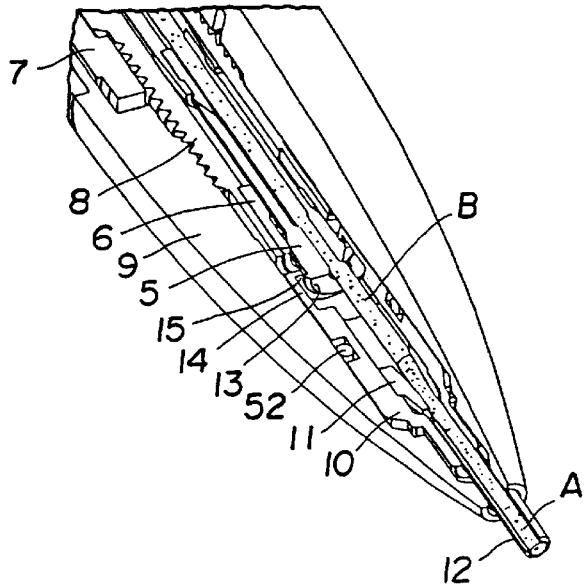
FIG. 19 is an enlarged perspective view, partly sectioned, of the structure shown in FIG. 18.

A twelfth embodiment of the invention will be described with reference to FIGS. 18 and 19. A description with reference to the structure and elements which are similar with those of the previous first embodiment will be omitted for clarification. On an outer circumference of the slide member 10, an O-ring 52 of a rubber-like resilient material is slidably press-fitted to an inner surface of the front member 9. This O-ring can be replaced by a projection or the like which is formed integrally on the slide member 9. A sliding resistance force of the slide member 10 relative to the front member 9 is set to be larger than a sliding resistance of the lead relative to the anti-retraction member 11. In other words, when the residual lead A is urged to be pushed by the succeeding lead B, the slide member 10 as well is urged to be pushed out together, but the sliding resistance between the slide member 10 and the front member 9 is strong enough and, consequently, the slide member is maintained still and, on the other hand, the residual lead A is pushed out.

The chuck body 5 is a so-called collet chuck which has a two-split, three-split or four-split leaves structure so that if it is forcibly closed while it has no writing lead grasped therein, the outer flange portion 13 of the chuck body 5 is taken out of the inner flange portion 15 of the slide member 10. In other words, the chuck body 5 and the slide member 10 can be assembled and disassembled with each other.

The middle step portion 17 of the slide member 10 is contacted with the front inner surface of the front member 9 and an inner step portion 18 is formed for limiting a forward movement of the slide member 10.

Figure 20:
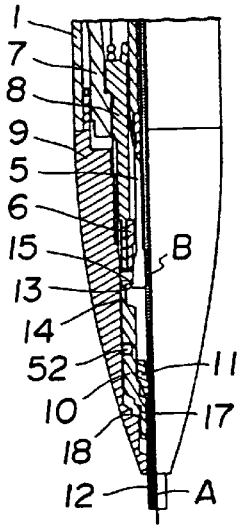
FIGS. 20 to 25 show an operational mode of the mechanical pencil.

An operation mode will be described. FIGS. 18 to 20 show a state that a residual lead A which has left from the chuck body 5 is maintained by the anti-retraction member 11 and the succeeding lead B is held or gasped by the chuck body 5. When the lead tank 2 is pushed forward in this state, the chuck body 5 is advanced in the tubular portion 14 together with the chuck ring 6 so that the succeeding lead B which is grasped by the chuck body 5. Along with the advance of the succeeding lead B, the residual lead A is pushed and urged to be advanced, but since the residual lead A is held by the anti-retraction member 11, the slide member 10 is also urged to be advanced. Actually, however, a sliding resistance force of the slide member 10 relative to the front member 9 is set to be larger than a sliding resistance force of the lead relative to the anti-retraction member 11 and, therefore, the residual lead A is advanced with the slide member 10 being maintained still in a rested position, so that the residual lead A project from a tip of the slide member 10 (that is, from an end of the lead protection tube 12). Incidentally, if the aforementioned relationship of the sliding resistance forces is made reversed, there is an outcome that the slide member is advanced in the first place and then the lead is belatedly projected from the end of the slide member 10 and, therefore, it gives some feeling of wrongness.

Figure 21:
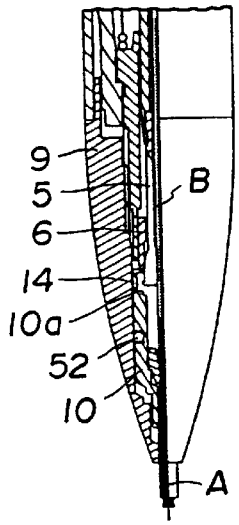

When a further advance is made with respect to the chuck body 5 and the chuck ring 6, etc., the front end of the chuck ring 6 is contacted with a rear end of the slide member 10 to thereby restrict the chuck ring 6 from moving forward (advance) as shown in FIG. 21.

However, since the chuck body 5 is advanced further, it is released from the chuck ring 6 so that, at this moment, the engagement between the chuck body 5 and the succeeding lead B is released.

Figure 22:
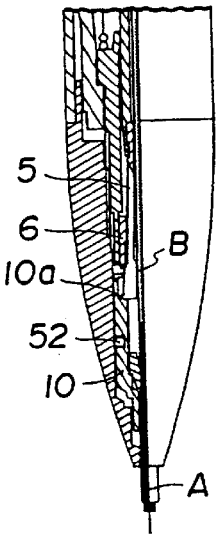

In this state, when the chuck body 5 is further advanced until the front end of the chuck body 5 is contacts the inner step portion 10*a* of the slide member 10, the chuck body 5 serves to advance the slide member 10. At this moment, since the residual lead A is softly held by the anti-retraction member 11, the residual lead A is advanced according to the advance of the slide member 10. However, since the succeeding lead B is released from the chuck body 5, the succeeding lead B is advanced with maintaining its contact with the residual lead A like a drop by gravity (FIG. 22).

Figure 23:
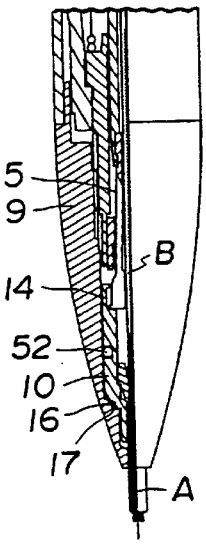

Then, when the middle step portion 16 of the slide member 10 is contacted with the inner step portion 17 of the front member 9, the advance X or forward movement of the slide member 10 is limited. This is shown in FIG. 23.

By the operation described above, the leads (that is, the succeeding lead B and the residual lead A) and the lead protection tube 12 which is fixed by slide member 10 are advanced relative to the front member 9 so that a length of the lead projecting from the front member 9 is increased relative to the projecting length of the same at the initial stage.

Figure 24:
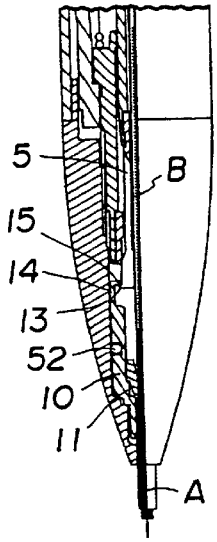

Now, when the advancing movement of the lead tank 2 is released, the chuck body 5 which releases the succeeding lead B and the outer flange portion 14 which contacts nothing in the tubular portion 14 move in a backward direction. If a contact resistance between the slide member 10 and the front member 9 is made larger than a contact resistance between the chuck body 5 and the slide member 10, the outer flange portion 13 can be moved in a contacted state. In other words, it is sufficient that the chuck body 5 is moved backward while the slide member is standing still. When the outer flange portion 13 of the slide member 10 comes into contact with the inner flange portion 15 of the slide member 10 in this backward movement, the slide member 10 is retracted and, at a little moment later, the chuck body 5 is closed by the chuck ring 6 and holds or grasps again the succeeding lead B (FIG. 24). By the operation described above, the residual lead A is softly held by the anti-retraction member 11 of the slide member 10 and, therefore, the residual lead A is retracted together with the slide member 10 with the projected length thereof being maintained. Further, the succeeding lead B which is held by the chuck body 5 is retracted together with the chuck body 5.

Figure 25:
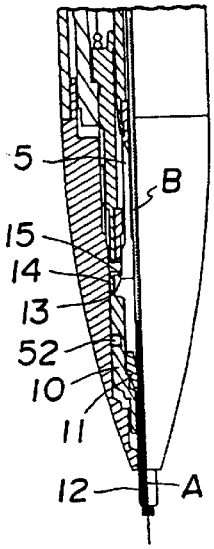

By the operation described above, the succeeding lead B and the residual lead A which are retracted together with the slide member 10 relative to the front member 9 are not retracted relative to the lead protection tube 12 (slide member 10) and, accordingly, there is no case that the projecting length of the lead from the lead protection tube 12 is decreased, see FIG. 25.

Further, the slide member 10 is press-fitted into and contacted with an inner surface of the front member 9 by the O-ring 52, the position of the slider member 10 is maintained after the pressing operation is released, no space is formed between the succeeding lead B and the residual lead A, the space being likely to be produced when the lead drops by gravity.

Figure 26:
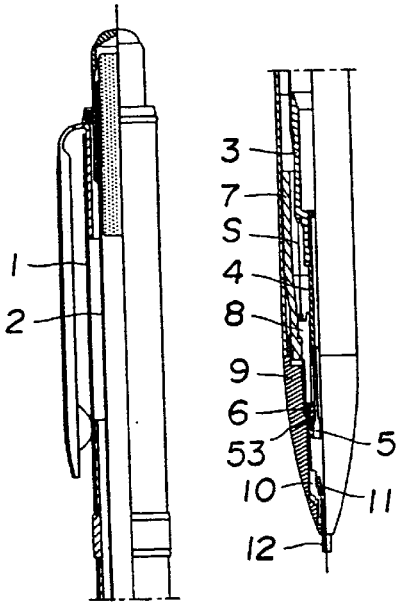
FIG. 26 is a longitudinally sectional view of a pencil according to a thirteenth embodiment of the invention.
Figure 27:
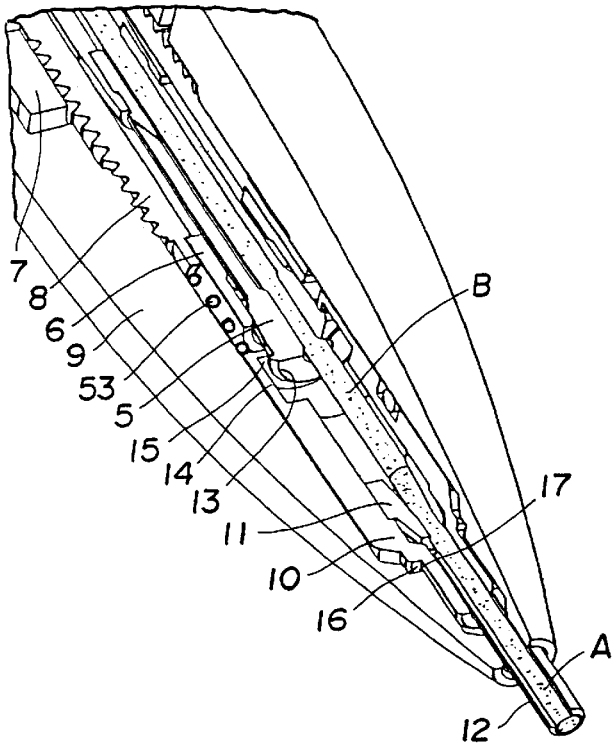
FIG. 27 is an enlarged perspective view, partly sectioned, of the structure shown FIG. 26.

FIGS. 26 and 27 show a thirteenth embodiment of the invention. Description of the structure and elements which are substantially similar to those of the first embodiment will be omitted for simplification only. Between a rear end of the slide member 10 and the connecting member 8 is provided a resilient member 53 such as a coil spring which urges or biases the slide member 10 in the forward direction. A spring force of the resilient member 53 for biasing the slide member in the forward direction is larger than a slide-contact force of the outer flange portion 13 relative the an inner surface of the tubular portion 14 of the slide member 10 when the chuck body 5 is opened. In other words, the slide member 10 is always biased in the forward direction whether or not the slide member 10 is movably contacted with, or movably inserted into, the inner surface 14 of the outer flange portion 13.

Figure 28:
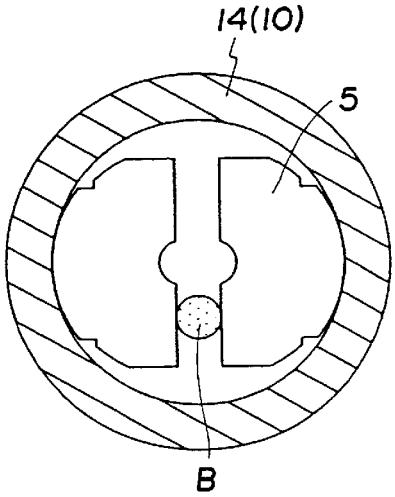
FIG. 28 is a diagram which shows a state that a writing lead is grasped or held.

The chuck body can be used so that the outer flange portion of the chuck body does not contact the tubular portion of the slide member. In case that a chuck body is made of a resin, it is general that the expansion or dilation is designed to be larger in view of the defects by the time. Thus, it sometimes contacts the inner surface of the slide member. Thus, it may be possible to make the inner diameter of the tubular portion larger so that the outer flange portion does not contact the inner surface of the tubular portion but this will require a larger dimension of the outer surface of the tubular portion and, as a result, size of the front member becomes larger. Further, in that case, the opening or dilating dimension of the chuck body is large so that if the lead is even slightly curved or slightly smaller than the requirement, the lead is then gripped at its unfair portion apart from the holding position of the chuck body (FIG. 28), and therefore, it possibly provides misdirection of the lead feeding operation. Thus, in this embodiment, a tubular portion of the slide member is made smaller and, at the same time, the outer flange of the chuck body is contacted with the inner surface of the tubular portion so that the opening degree of the chuck body is restricted to thereby permit the lead to be gripped by and at the predetermined correct position of the chuck body.

Figure 29:
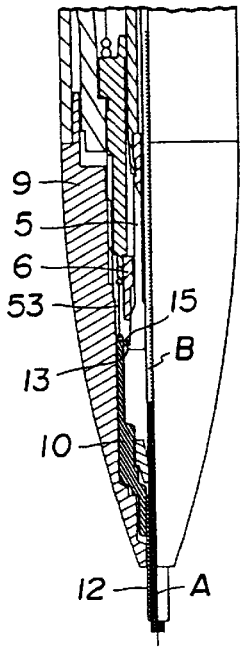
FIG. 29 shows an operational mode of the pencil.

An operation will be described except for the advancing operation of the chuck body and the slide member which is substantially same as that of the first and twelfth embodiments described above. When the advance movement (forward movement) of the lead tank 2 is released, the chuck body 5 is retracted with is gripping mouth opened and its outer flange portion 13 being frictionally slid along the inner surface of the tubular portion 14, but since the slide member 10 having the tubular portion 14 is forwardly biased by the resilient member 53, the slide member 10 does not proceed retraction. Then, the chuck body 5 contacts at its outer flange portion 13 with the inner flange portion 15 of the slide member 10 and, from at this moment, the slide member 10 starts its retraction (see FIG. 29). This of course occurs against a spring force of the resilient member 53.

The chuck body 5 is forcibly closed by the chuck ring 6 to hold again the succeeding lead B and, at this moment, the chuck body 5 will be slightly retracted in a similar manner as the conventional prior art structure but also the slide member 10 is retracted. Therefore, no space or gap is produced between the succeeding lead B and the residual lead A.

Although the succeeding lead B and the residual lead A are retracted by the operation described above, the lead is retracted together with the slide member 10 relative to the front member 9 and, therefore, it does not retract relative to the lead protection tube 12 (that is, slide member 10), so that a projecting length of the lead from the lead protection tube 12 is not decreased.

The slide member 10 engaged with the outer flange portion 13 of the chuck body 5 and its retracting position is maintained after the pushing operation is released and, therefore, any gap or space is not produced between the succeeding lead B and the residual lead A by, for example, a drop of the lead by gravity or a biasing force of the resilient member 53.

Figure 30:
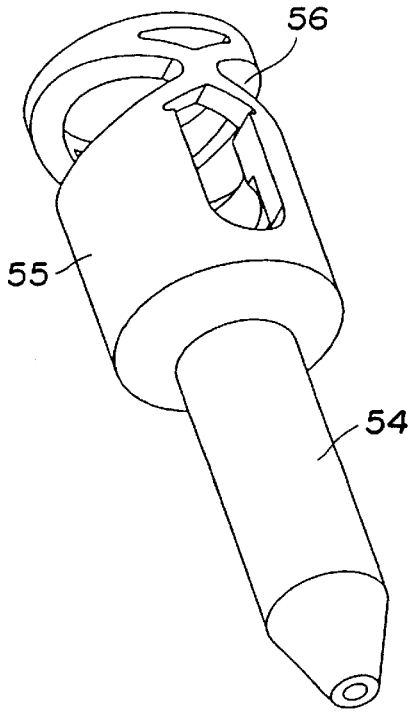
FIGS. 30, 31 and 32 show an example of a slide member.
Figure 32:
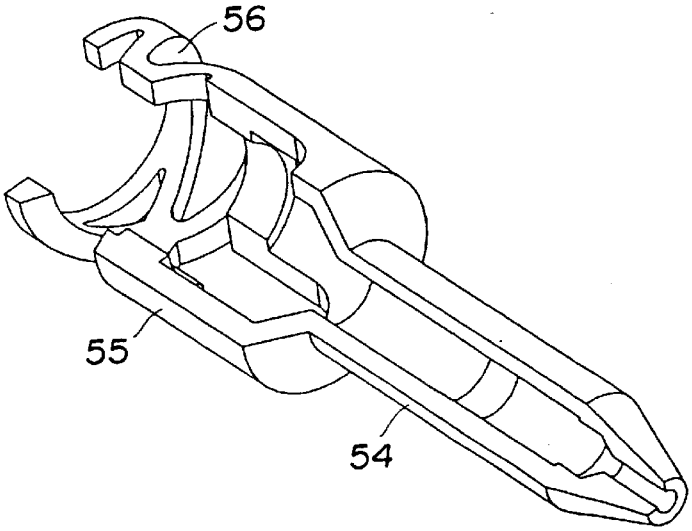

In the preceding examples described above, the resilient member and the slide member are made of different members and assembled with each other but if necessary, an elastic member is formed by an injection molding method or the like at a rear portion of the slide member, as shown in FIGS. 30 and 32. More specifically, this structure of the elastic portion which can be deformed, a tubular portion 55 is formed at the rear portion of the slide member 54 and the tubular portion 55 has its rear end an elastically deformable portion 56 of net shape.

Figure 31:
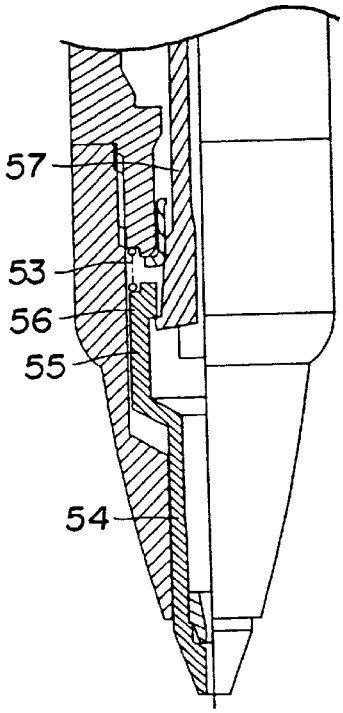

FIG. 31 shows an example of production of the slide member 54 and the chuck body 57 in which both of the members 54 and 57 are made of a resin material by an injection molding method. As described above, the resin-made chuck 57 is, at its opened state, contacted at its outer circumference to the inner circumference of the tubular portion 55 so that its opening degree is restricted. Specifically, the opening degree is made slightly smaller than a diameter of the writing lead. This of course is made for the purpose of hold the lead at the regular position thereof.

In this embodiment the elastic, deformable portion is provided at the rear portion of the slide member but, if desired, a tension spring can be provided at a front portion of the slide member. In an alternative method, a magnet is used for biasing the slide member forwardly.

FIGS. 33 to 36 show a fourteenth embodiment of the invention. In this embodiment, a lead tank 59 is axially slidably disposed in the tubular shaft 58, and a chuck body 60 which can be opened and closed at the front end of the lead tank 59. At the front portion of the lead tank 59 is provided a chuck ring 61 which serves to open/close the chuck body 60. A base portion 62*a* of a clip 62 is press-fitted to a rear portion of the tubular shaft 58, and a rubber eraser 63 is detachably fitted to a rear portion of the lead tank 59. Reference numeral 54 is a end cap which is detachably fitted to the rear portion of the lead tank 59 for covering the rubber eraser 63.

A front member 65 is detachably fitted to a front end of the tubular shaft 58 by means of threaded engagement or the like, and a grip 66 made of a rubber material is coated in such a manner that it is laid across and extended between the tubular shaft 58 and the front member 65 so that the elements 65 and 58 should not be removed from each other inadvertently or accidentally. The slide member 67 is axially movably disposed in the front member 65, and an anti-retraction member 68 made of a rubber or synthetic resin material is press-fitted to the interior of the slide member 57 for softly holding the writing lead. If necessary, a lead guide member made of a suitable resin can be disposed at the rear portion of the anti-retraction member. Reference numeral 69 represents a lead protection tube which is formed integral with an end of the slide member 67. The lead protection tube 69 can be formed of a metal pipe and press-fitted. Reference character "S" represents a coil spring which spring-biases the chuck body 60 and the lead tank 59 in the rearward direction.

Figure 35A:
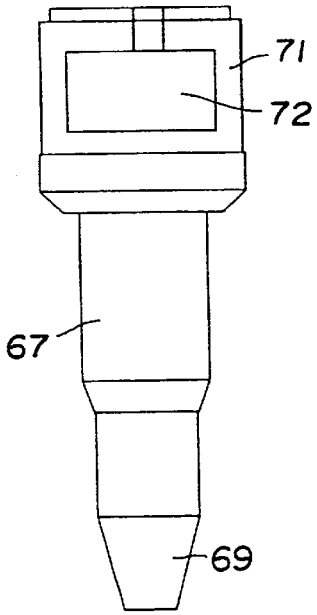
Figure 35B:
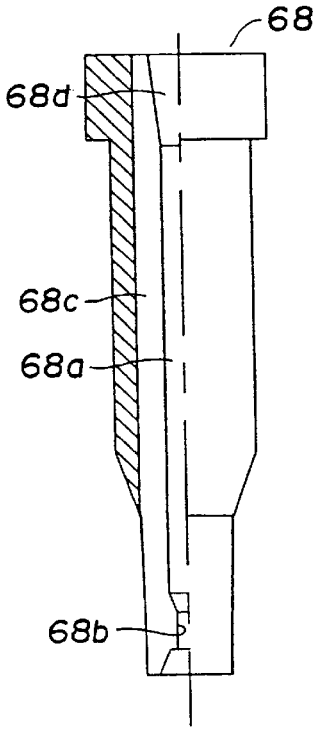
Figure 35C:
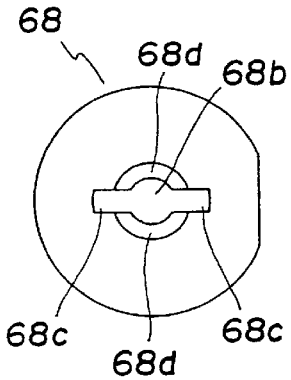
Figure 36:
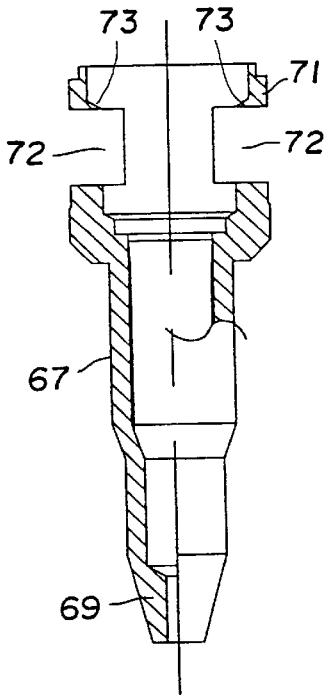

A further description will be made with reference to the chuck body 60 and the slide member 67. The chuck body 60 has, at its front end surface, projections 70, 70 in an opposed relation. At the rear portion of the slide member 67 is provided a tubular portion 71 which has at a middle portion thereof an engagement hole 72 to which the projections 70, 70 of the chuck body 60 (FIGS. 35A, 35B and 35C). The tubular portion 71 has an inclined surface 73 which slants gradually toward the front end as illustrated in FIG. 36, so that it facilitates a smooth insertion of the projections 70, 70 of the chuck body 60 into the engagement hole 72. In other words, this makes it easy to assembly the chuck body 60 to the slide member 67.

A resilient member 74 such as a coil spring is provided between a rear end of the slide member 67 and the tubular shaft 58 to spring-bias the slide member 67 in the forward direction. A spring force of the resilient member 74 for spring-biasing the slide member 67 is larger than a sliding frictional force of the edge portion 75 except the projections 70, 70 at the time when the edge portion 18 is slidably contacted with an inner surface of the tubular portion 71 of the slide member 67. Namely, the slide member 67 is always urged to move forward, irrespective of the state whether or not the edge portion 75 of the chuck body 60 is slidably contacted with the inner surface of the tubular portion 71.

Again, the chuck body 60 is of collet type chuck mechanism having two-split, three-split or four-split configuration. A middle step portion 76 of the slide member 57 is contacted with the inner front portion of the front member 65, and an inner step portion 77 is formed to limit the advancing distance of the slide member 67.

Figure 37:
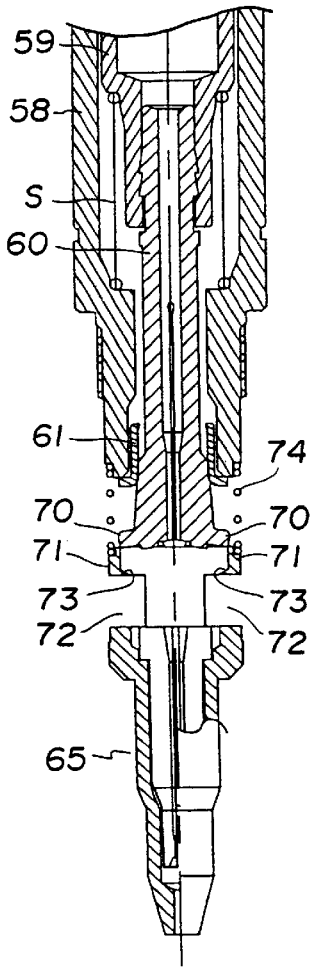
FIGS. 37 and 38 are sectional views showing an operational mode of a lead holding mechanism.
Figure 38:
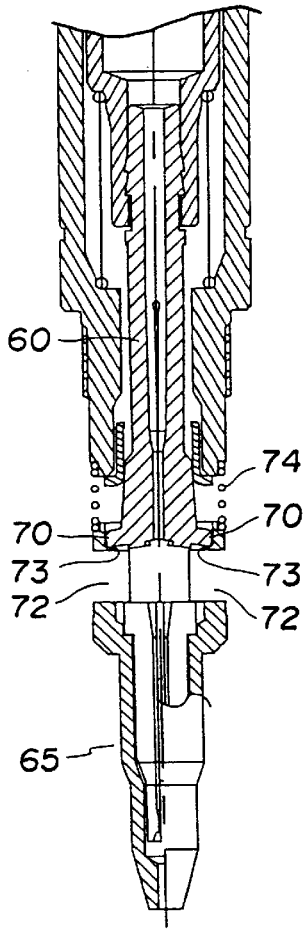

An assembly procedure of the chuck body 60 to the slide member 67 will be described. In the state that no lead is grasped by the chuck body (in the state of FIG. 37), the projections 70, 70 of the chuck body 60 is pressed against the rear end of the slide member 69 (that is, tubular portion 71), a head of the chuck body 60 is reduced in its diameter (FIG. 38) On the inner front portion of the front member 65, and in a short time the projections 70, 70 are moved to the engagement hole 72 and, at time moment, the projections 70, 70 of the chuck body 60 are released so that the hed of the chuck body 60 is dilated. Thus, the projections 70, 70 of the chuck body 60 are freely inserted into the engagement hole 72 so that they are placed into a somewhat inseparable state (that is, the state of FIG. 33).

The anti-retraction member 68 for preventing the lead from moving back or retracting to a rear position will be described. The anti-retraction member 68 has, along its length, a lead passage 68*a* with a diameter a slightly larger than a diameter of a writing lead but not so large as to permit two leads to pass at a time. At the front portion of the lead passage 68*a,* the anti-retraction portion 68*b* which has a hole of a diameter slightly smaller than a diameter of the lead to be used. The anti-retraction member 68*b* holds the lead softly and serves to prevent the lead from retracting or moving backward. In the state that the lead is held by the anti-retraction member 68*b,* the lead is held at a ridge portion so that this can prevent the residual lead from rotating at the time of writing. The lead passage 68*a* is provided with a groove portion 68*c* in a confronting relation relative to an axial direction, the groove portion 68*c* being smaller than a diameter of the lead, and the groove portion 68*c* is formed along the entire length of the anti-retraction member 68. Further, at the area adjacent to the anti-retraction portion 68*b,* the groove portion 68*c* is formed extending until an outer circumference of the anti-retraction member 68. In other words, the groove portion 68*c* adjacent the anti-retraction portion 68*b* is of slit-shape configuration. A resilient effect is added to the anti-retraction portion 68*b* which serves to actually hold the lead so that a dispersion of the lead diameter can be absorbed. The groove portion 68 is shown to be provided at two spots in the illustrated embodiment but it may be provided radially at three sports or four spots. Further, it may be formed such that it is a groove having a triangular cross section. The lead passage 68*a* has at its upper portion a cone shaped portion 68*d* for reliably guiding the lead to the lead passage 68*a*.

Further, the anti-retraction member 68 is formed of a resin material. The position of a gate (that is, a hole for cavity) at the time of injection molding is provided at right angles relative to an axial line of the lead passage 68*a* and at the position where the aforementioned groove portion 68*c* is formed (FIGS. 35A to 35C). By providing a flow of the resin material from the position where a core pin has more strength, the core pin is prevented from being bent or broken. Further, the groove portion 68*c* serves to absorb scattering or dispersion of the diameter of the leads when the anti-retraction member 68 is press-fitted to the slide member 67 and also serves to maintain a suitable strength of fixture. In other words, an elastic deformation of the anti-retraction member 68, which is effected by the groove portion 68*c,* is utilized effectively. In this embodiment, the lead passage 68*a* and the anti-retraction portion 68*b* are formed in a unitary structure but they may be formed independently or separately from each other so that the anti-retraction portion may be positioned at a front of the member which has the lead passage as shown by, for example, FIG. 53.

Figure 33:
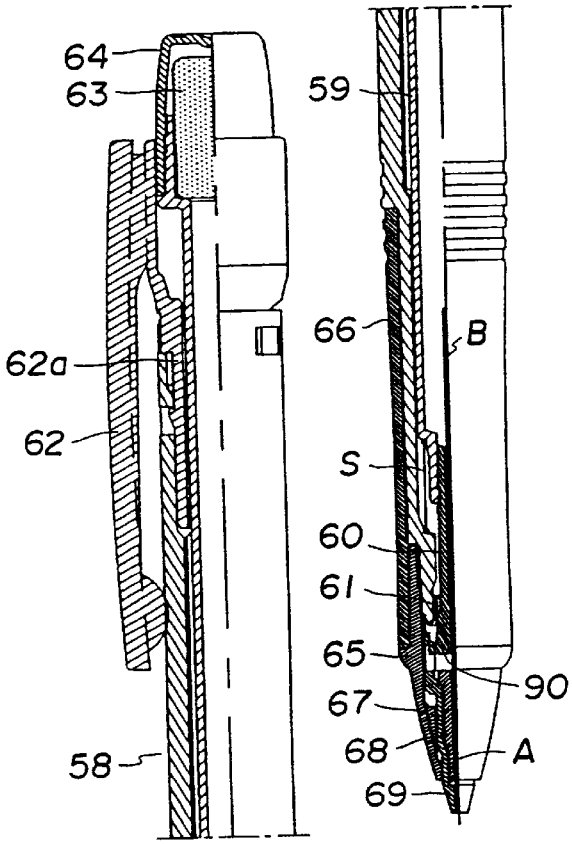
FIG. 33 is a longitudinally sectional view of a mechanical pencil according to a fourteenth embodiment of the invention.
Figure 34:
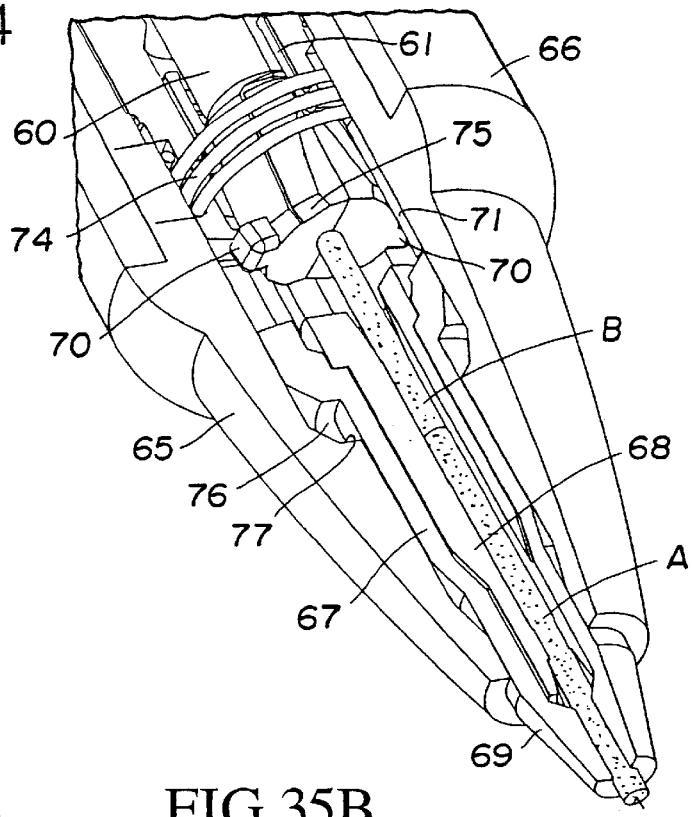
FIGS. 34 to 36 are enlarged views of elements shown in FIG. 33.

An operation mode will then be described. FIGS. 33 and 34 show the state in which the residual lead A left from the chuck body 60 is held by the anti-retraction member 68 and the succeeding lead B is held by the chuck body 60. The slide member 67 is spring-biased forwardly by the resilient member 74 but, since the rear end of the engagement hole 72 of the tubular portion 71 is in an abutment engagement with the projections 70 of the chuck body 60, the slide member 67 is restricted from advancing movement.

When the lead tank 59 is pushed froward in the state described above, the chuck body 60 is advanced in a non-contact state in the tubular portion 71 together with the chuck ring 61 but, since the slide member 67 is spring-biased by the resilient member 74, also the slide member 67 is advanced with the engagement between the engagement hole 72 and the projection 71 being maintained. Consequently, the succeeding lead B held by the chuck body 60 and the residual lead A held by the anti-retraction member 68 is advanced together with the guide member 67.

Figure 39:
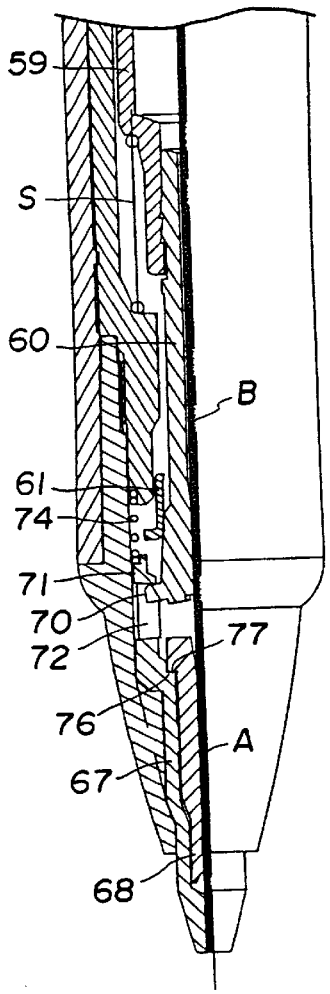
FIGS. 39 to 42 are sectional views showing an operation of the lead holding mechanism.
Figure 40:
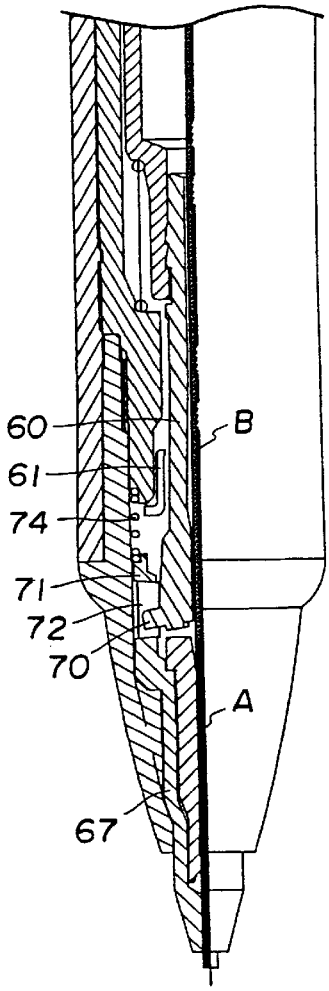

In a short time, the middle step portion 76 of the slide member 67 abuts against the inner step portion 77 of the front member 65 to stop the advancing movement of the slide member 67 (FIG. 39). However, the projections 70 of the chuck body 60 are freely inserted into the engagement hole 72. Although the chuck body 60, the chuck ring 61 and the succeeding lead B as well as the residual lead A are advanced further, the chuck ring 61 is prevented from moving further at the time when the chuck ring 61 abuts against the rear end of the tubular portion 71 of the slide member 67. Then, at this moment, the chuck body 60 is dilated or opened to release the succeeding lead B and the edge portion 75 of the chuck body 60 contacts the inner surface of the tubular portion 71 of the slide member 67 (FIG. 40).

Figure 41:
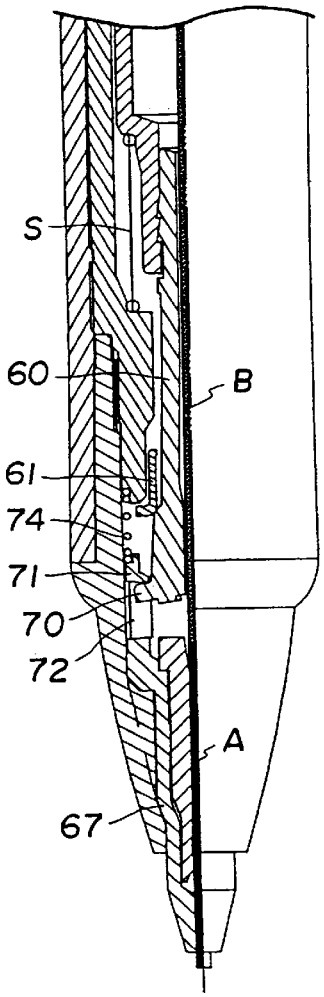

When the advancing movement of the lead tank 59 is released, the chuck body 60 is retraced with its holding portion being opened and with edge portion 75 being frictionally slid along an inner surface of the tubular portion 71 but, since the slide member 67 having the tubular portion 71 is spring-biased by the resilient member 7, the slide member 67 is not retracted. When the projections 70 are contacted with the rear end of the engagement hole 72 of the slide member 67, the slide member 67 starts its retracting movement (FIG. 41). This is done against a spring force of the resilient member 74.

Figure 42:
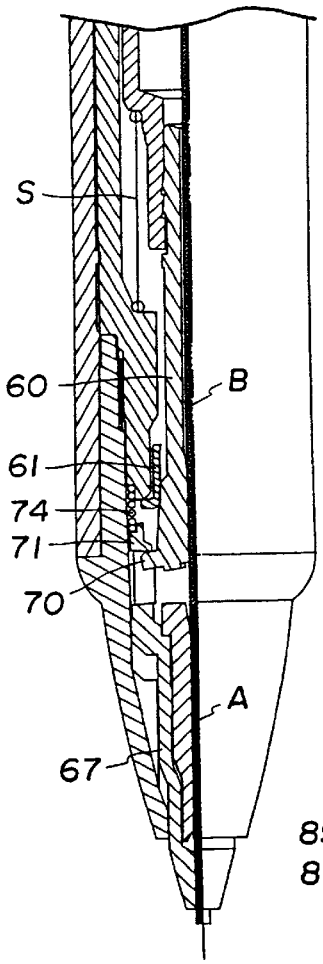

Then, the chuck body 60 is closed by the chuck ring 61 to hold again the succeeding lead B (FIG. 42). In this case, the chuck body 60 is slightly retracted in a similar manner as the prior art device with the succeeding lead B being grasped but, since the slide member 67 as well is retracted, no gap or air space is produced between the residual lead A and the succeeding lead B.

By the operation described above, the succeeding lead B and the residual lead A are retracted, but the leads A and B are retracted together with the slide member 76 relative to the front member 65. Consequently, the leads A and B are not retracted relative to the lead protection tube 69 (slide member 67) and, therefore, a projecting length of the lead from the lead protection tube 69 is not decreased.

Further, the slide member 67 is engaged with the projections 70 of the chuck body 60 similarly as the previous embodiments and maintains its retracting position after the pushing operation is released, no space is formed between the succeeding lead B and the residual lead A due to, for example, a drop of the lead by gravity.

Figure 43:
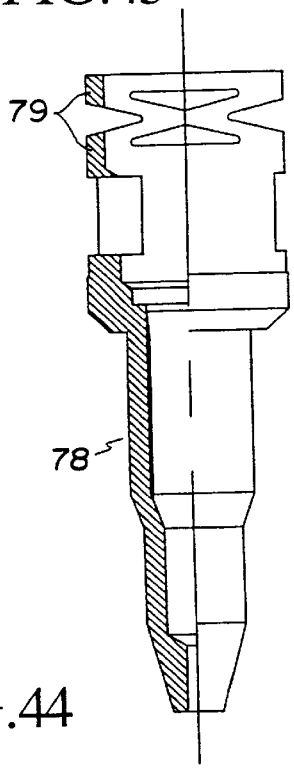
FIG. 43 shows a structure of the slide member.

The resilient member and the slide member which are formed of separate members in the embodiment described above but they may be formed in a unitary structure by a suitable method as an injection molding as illustrated in FIG. 43. With respect to the elastically deformed portion in the present embodiment, an elastically deformable portion 79 of a shrinkable net shape is formed at a back of the slide member 78.

Figure 44:
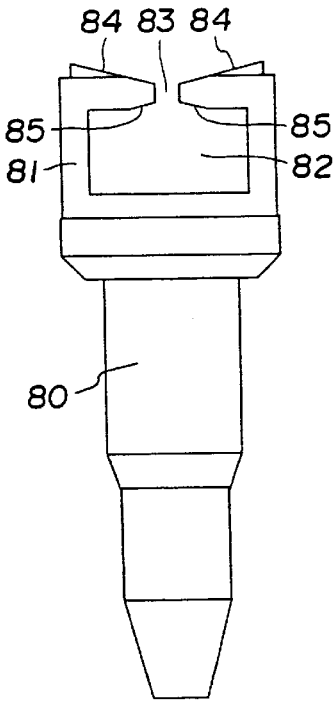
FIG. 44 shows a modification of the slide member shown in FIG. 43.

A modified structure will be explained with reference to FIG. 44. In this modification, an engagement hole 82 is formed on a tubular portion of the slide member 80 and a slit 83 narrower than the projections 70 of the chuck body 60 are formed. On the rear end of the tubular portion 81, an inclined surface 84 is formed for facilitating adoption or fitting of the projections 70 to the engagement hole 82.

Figure 45:
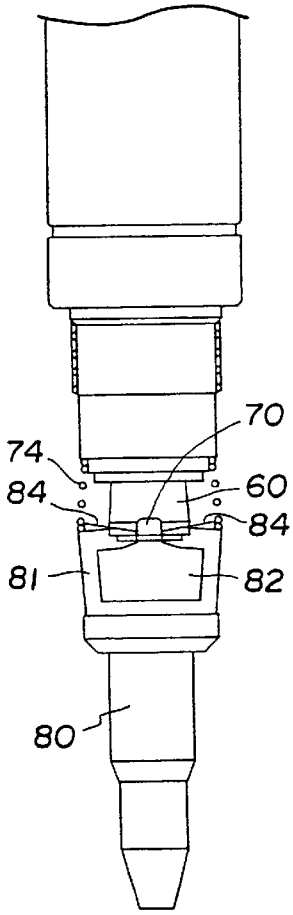
FIG. 45 is a diagram showing an operation of the slide member.

When the projections 70 of the chuck body 60 are pushed against the inclined surface 84, the tubular portion 81 is elastically deformed at the center of the slit 83 (see FIG. 45), so that the projections 70 are reliably introduced into the engagement hole 82.

Further, the engagement hole 82 is provided, at its inner surface, with an inclined surface 85 in a confronting relation with the aforementioned inclined surface 84. The inner inclined surface 85 permits the chuck body 60 be removed from the slide member 67. In other words, maintenance can be done by separation of the two members 60 and 67 from each other when the lead in the slide member should be broken.

Figure 46:
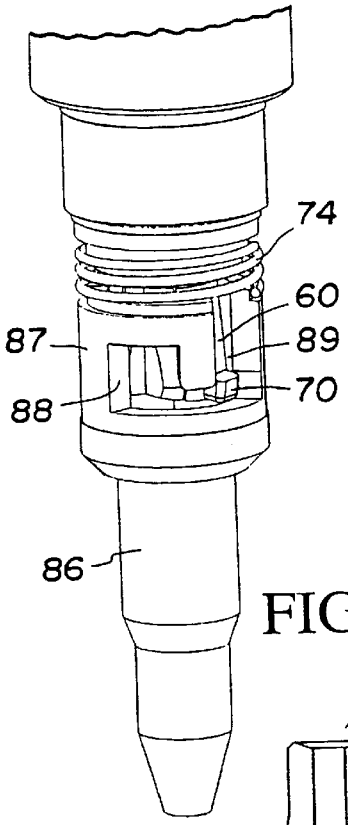
FIGS. 46 and 47 show modifications of the slide member.
Figure 47:
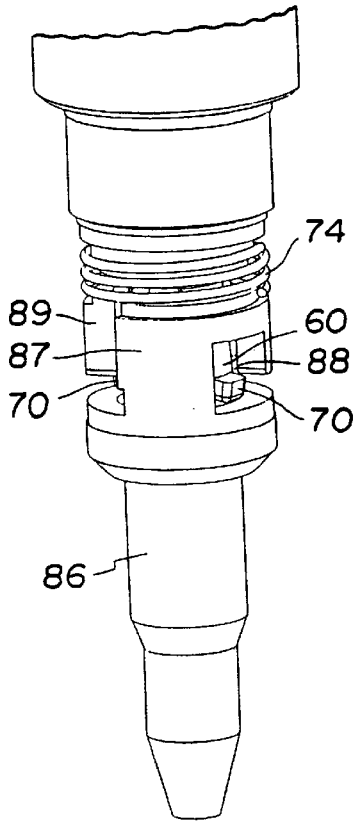

A modification of the engagement hole will be described with reference to FIG. 46. The slide member 86 has an engagement hole 88 on a tubular portion 87 in a similar manner as the previous embodiment, and in this modification, an L-shaped guide groove 89 is formed in continuation with the engagement hole 88. The guide groove 89 is extended to the end of the tubular portion 87. In this modification, the chuck body 60 and the slide member 86 are assembled by rotating the one relative to the other (FIG. 47). This permits an easy assembly operation and an easy disassembly of the chuck body and the slide member when the lead is broken in the slide member.

In the embodiment described above, since the projecting length of the chuck body from the chuck ring is small and there is a distance for the resilient member to be closely contacted, assembly must be made by rotating the slide member while a knock cap is pushed to urge the chuck body for a some distance. In this point, if the chuck body is formed longer, the slide member can be assembled without moving the chuck body in the forward direction.

In the embodiment described above, the engagement portion is formed in the form of the through-hole and, therefore, its working can be made easily and, especially when the slide member is formed by injection molding, the molding dies can be made at a low cost and dimensional accuracy can be obtained.

Figure 48:
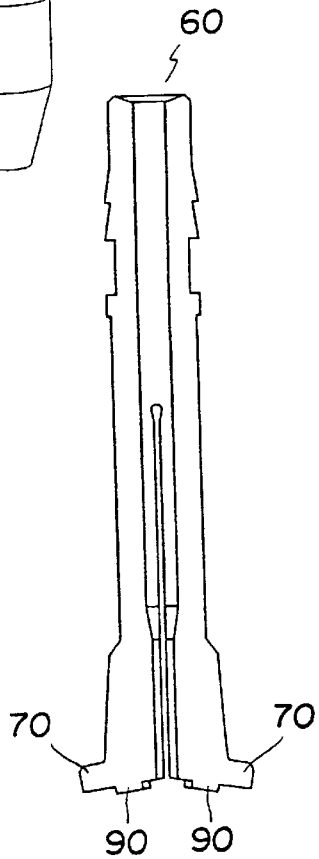
FIGS. 48 to 51 show examples of a chuck body adapted to the mechanical pencil of the invention.
Figure 49:
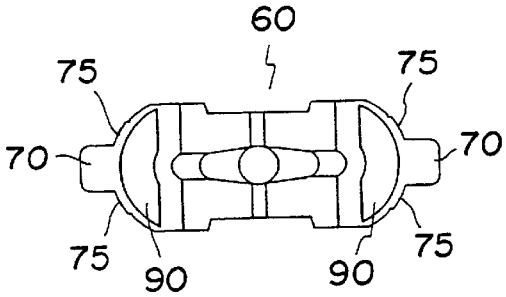
Figure 50:
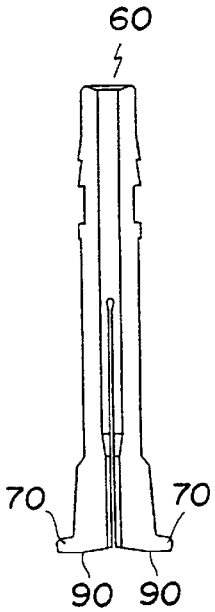
Figure 51:
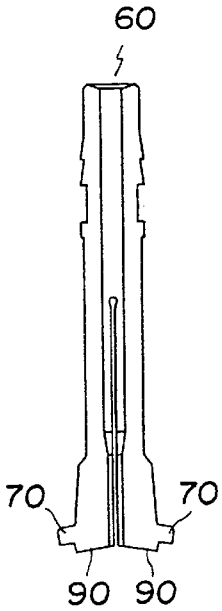

A fan shaped expansion portion 90 is formed on a front end of the chuck body 60 so that the fan shape corresponds to the shape of the chuck body 60 (FIGS. 48 and 49). The expansion portion 90 serves as a pusher portion when the lead tank 59 is press-fitted to the lead tank 59. A method of the press-fitting will be described later. In the present embodiment of the invention, in stead of the fan-shaped expansion portion, a hill-shaped raised portion is formed at a center of the front surface of the chuck body 60 as shown in FIG. 50 and in a further modification, a front end of the chuck body 60 is continuously extended forward from the projections 70 as shown in FIG. 51.

Figure 52:
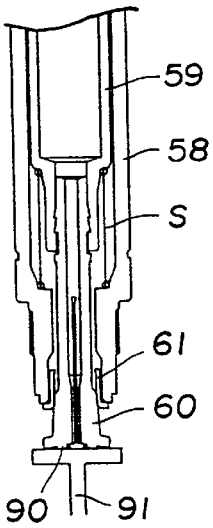
FIG. 52 is a diagram showing a method of assembly of the chuck body.
Figure 54:
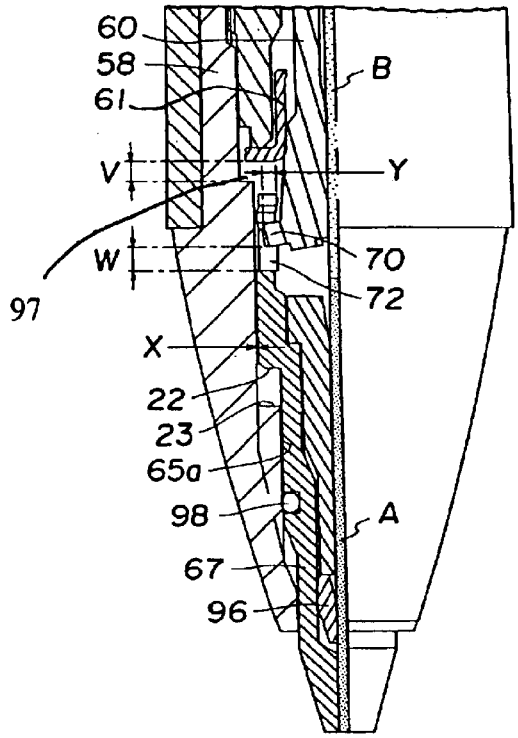
Figure 55:
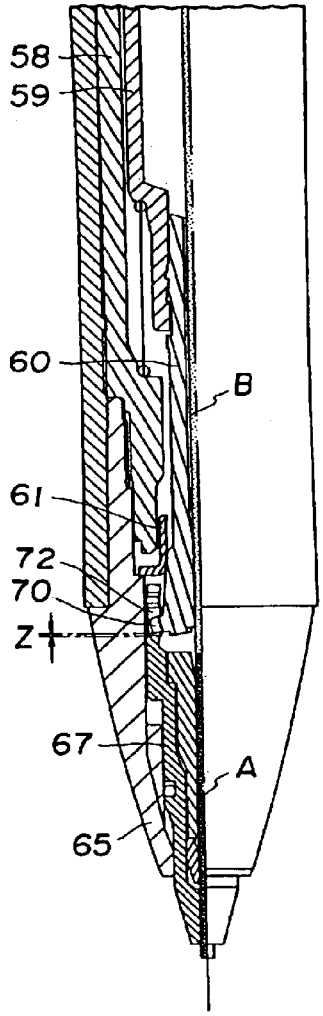
FIGS. 55 to 58 are sectional views showing an operation of the pencil according to the fifteenth embodiment of the invention.

Assembly of the chuck body 60 to the lead tank 59 will be described with reference to FIG. 52. In the first place the lead tank is positioned in an upright posture and the resilient member S is inserted from forward position into the lead tank 59. Then, the tubular shaft 58 is fitted from above of the lead tank 60 and, after that, the chuck ring 61 is mounted from above on the tubular shaft 58, followed by insertion of the chuck body 60 of the present embodiment. Next, the pusher member 91 is contacted against the expansion portion 90 of the chuck body 60 to provide a downward force upon the pusher member 91. Thus, chuck body 60 receives a force of the pusher member 91 through the expansion member 90 and the lower portion of the chuck body 60 is press-fitted to lead tank 59. At this moment, when an excessive force is added to the chuck body 60 by the pusher member 91, the expansion member 90 at the front end of the chuck body 60 is deformed inwardly or outwardly so that deformation of the front portion of the chuck body is restricted. In other words, a regular assembly can be accomplished with the predetermined shape being maintained, without deformation of the front portion of the chuck body, wherein the front portion is to be contacted with the chuck ring 61.

In the embodiment described above, the projections 70 are formed on the outer circumference of the chuck body 60 and the projections 70 are engaged with the slide member 67, so that the slide member 67 is retracted to thereby remove a gap between the residual lead A and the succeeding lead B. In other words, the shape of the projections 70 is an important factor. Accordingly, if the projections 70 are deformed, retracting positions of the slide member 67 becomes different and scattered and, as a result, a projecting length of the lead will become scattered. In some cases, the projections 70 are damaged or broken and, in that case, it is impossible to retract the slider to the predetermined position. For the purpose of avoiding such disadvantages, it is desired to form the expansion portion 90 as described above.

FIGS. 53–58 show a fifteenth embodiment of the invention. The same reference numerals are used for the same or similar parts and structures of the fourteenth embodiment. The lead tank 59 is axially movably disposed in the tubular shaft 58 and the chuck body 60 is fixedly positioned at the front end of the lead tank 59. The chuck ring 61 is disposed at the front portion of the chuck body 60 to open/close the chuck body 60. The resilient member S such as a coil spring is disposed between the lead tank 50 and the inner step portion 93 of the tubular shaft 58 to spring-bias the elements such as the chuck body. Thus, a lead feed mechanism 94 is constituted by such elements as the lead tank 59, chuck body 60, chuck ring 61 and the resilient member S.

Further, at the front portion of the tubular shaft 58, the front member 65 is releasably engaged by a thread engagement or the like, and the slide member 67 is slidably positioned to the front member 65 such that the slide member 67 projects from the end of the front member 65. In the slide member 67, the lead guide member 95 and the anti-retraction member 96 of a resilient member such as a silicone, NBR or the like for holding softly the lead and prevent the retraction of the lead are provided. The lead guide member 95 and the anti-retraction member 96 may be formed integral with the front member 65. Further, the tubular portion 71 is formed at the rear portion of the slide member 67, and a window 72 is formed on the tubular portion 71 in an opposed relation. The tubular portion has a slit in continued relation with the window 72 so that if an external force is added to the tubular portion 71, it can be opened by elastic deformation. The projections 70 which are formed on the outer circumference of the chuck body 60 are movably inserted to the window 72.

A step portion 97 is formed on the inner rear portion of the front member 65 for the purpose of serving as a restriction portion which limits a forward movement of the chuck ring 61. When the chuck ring 61 is contacted with the step portion 97, the chuck body 60 is dilated to release the lead which was grasped therein.

A distance V between the chuck ring 61 and the step portion 97 is determined that it (V) is smaller than a distance W between the projection 70 of the chuck body 60 and the front end of the window 72 of the slide member 67. In other words, the chuck ring 61 is contacted with the step portion 97 to open the chuck body 60 and, after that, the projections 70 of the chuck body 60 is then contacted with the front end of the window 72. More specifically, the distance V is determined to be smaller by 0.1 mm than the distance W. If this difference is between 0.05 mm and 1.0 mm, the structure will work well. If the difference is 1.0 mm, however, the structure works but a length of the projecting lead becomes large and, therefore, it will be difficult to regulate the projection length of the lead.

Between the portion adjacent to the tubular portion 71 of the slide member 67 and the tubular shaft 58, there is provided a gap X which is determined to be smaller than an engagement distance Y between the chuck body 60 and the slide member 67. In other words, when the projections 70 of the chuck body 60 are inserted into (or fitted to) the window 72 of the slide member 67, the tubular portion 71 adjacent to the window 72 is dilated or opened but, after the front member 65 is fitted to the tubular shaft 58, the opening movement of the tubular portion 71 is restricted so that the movably inserted relation of the projections 70 relative to the window 72 can be maintained. In other words, the projections 70 are secured in the window 72 and does not fall out of the window 72. Further, the slide member of this embodiment has a slit 83 in a similar manner as the modified structure of the fourteenth embodiment, and the slit 83 has a width such that when the slit is dilated by fitting the slide member to the front member, the projections of the chuck body do not fall out. Namely, the difference between the width of the projections 70 of the chuck body 60 and the width of the slit 83 is larger than the difference between an inner diameter of the front member 65 and the outer diameter of the tubular portion of the slide member 67.

The O-ring 98 of a rubber-like material is disposed between the inner surface rib 65*a* of the front member 65 and the slide member 67 to provide a sliding frictional resistance force. The resistance force of the slide member 67 relative to the front member 65 is determined to be larger than a resistance force of the lead relative to the anti-retraction member 96. In other words, when the lead is advanced together with the chuck body 60, the slide member 67 is restricted from moving relative to the front member 65. Incidentally, a lead holding force of the anti-retraction member is preferably selected to be in the range of from 20 gf to 100 gf. A value below the range (less than 20 fg) will result in sliding drop of the lead whereas a value above the range (more than 100 gf) provides difficulties in lead feed operation. In the embodiment of the invention described above, the O-ring 98 is slidably contacted with the inner rib 65*a* of the front member 65. Instead of the inner rib 65*a*, the O-ring 98 can be contacted with the inner surface of the tubular portion, but in view of unexpected deformation of the O-ring and compression by air, it will be desirable to provide a rib structure.

A base portion 62*a* of the clip 62 is press-fitted to the rear portion of the tubular haft 58 and a rubber eraser 63 is releasably fitted to the rear portion of the lead tank 59. A knock cap 64 which covers the rubber eraser 63 is releasably disposed at the lead tank 59. A grip member 66 is mounted on the front portion of the tubular shaft 58 such that the grip member 66 rides over, and extends between, a recess 58*a* of the tubular shaft 58 and a recess 65*b* of the front member 65. This prevents a looseness or incomplete fitness of the front member 65 relative to the tubular shaft 58 and, at the same time, permits a full finger-gripping manipulation to the front member 65. This structure is substantially the same as the fourteenth embodiment of the invention.

Figure 53:
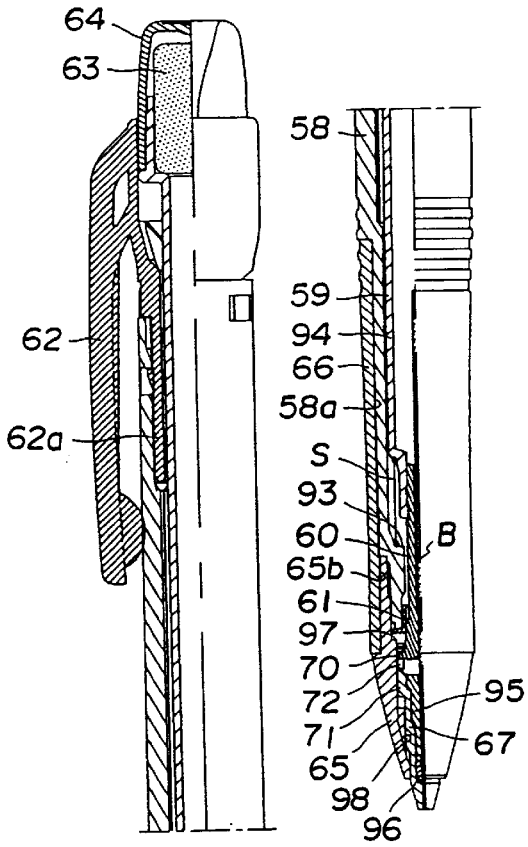
FIG. 53 is a longitudinally sectional view of a mechanical pencil according to a fifteenth embodiment of the invention.

An operation will be described. FIG. 53 shows the state that the residual lead A left from the chuck body 60 is held by the anti-retraction member 96, and the succeeding lead B is held by the chuck body 60. The slide member 67 is pulled rearward by the projections 70 of the chuck body 60.

Figure 56:
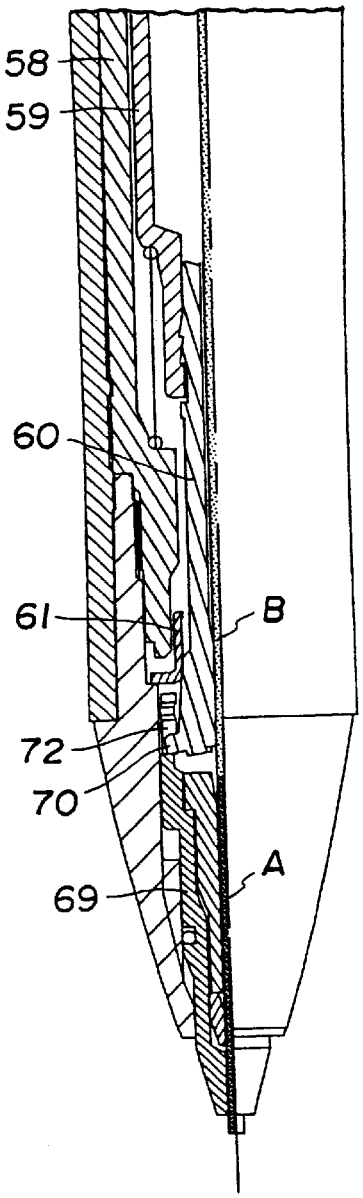

When the lead tank 59 is pushed forward, the chuck body 60 and the chuck ring 61 as well as the succeeding lead B held by the chuck body 60 and the residual lead A are moved forward, wherein the residual lead A is pushed by the succeeding lead B. At this moment, the residual lead A is softly held by the anti-retraction member 96 of the slide member 67 and therefore also the slide member 67 is urged to advance together but, since the sliding frictional resistance of the slide member 67 relative to the front member 65 is determined to be relatively large and, therefore, the slide member stands still without movement, and the residual lead A is slidably moved in the anti-retraction member 96, so that the residual lead A projects from the end of the slide member 67. Thereafter, the chuck ring 61 comes into contact with the step portion 97 of the front member 65 to thereby restrict its forward movement. At this moment, a gap "Z" (FIG. 55) is formed between the projection 70 of the chuck body 60 and the front end of the window 72 of the slide member 67. If the lead tank 59 is advanced further, the chuck body 60 advances slightly the succeeding lead B (and the residual led A) and at the same time the projections 70 of the chuck body 60 is forcibly contacted with the front end of the window 72 (FIG. 56). At this moment, the chuck body 60 is dilated or opened to release the succeeding lead B which was held. If necessary, however, it can be designed such that the chuck body 60 is dilated immediately after the chuck ring 61 contacts the step portion 97.

Figure 57:
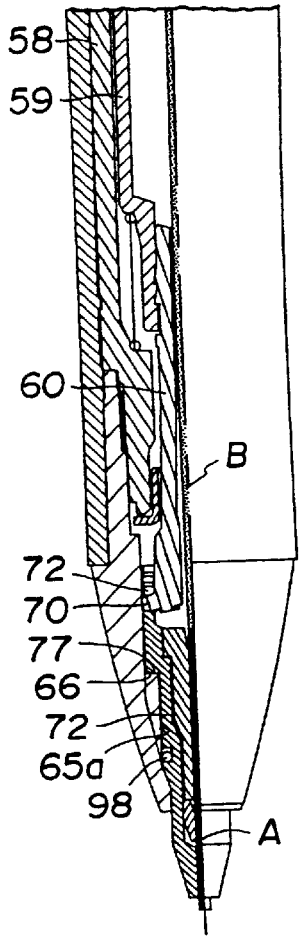

When the lead tank 59 is advanced further, the projections 70 of the chuck body 60 serve to move the slide member 67 forward. The forward movement of the slide member 67 continues until the middle step portion 76 of the slide member 67 abuts against the rear end 77 of the inner face rib 65*a* of the front member 65 (FIG. 57).

When the forward movement of the lead tank 59 is released, the chuck body 60 is retracted in its opened state, but the slide member 67 which receives a resistance by the O-ring 98 is not retracted. Soon after that, the projections 70 of the chuck body 60 contact the rear end of the window 72 of the slide member 67 (FIG. 58) to thereby start a retracting movement of the slide member 67.

In a short time, the chuck body 60 is forcibly closed by the chuck ring 61 to grip or hold again the succeeding lead B (FIG. 53). At this time, although the chuck body 60 is retracted slightly with holding the succeeding lead B therein in a similar manner as the conventional prior art, the slide member 67 as well is forcibly retracted and, therefore, no gap of air space is formed between the succeeding lead B and the residual lead A.

The succeeding lead B and the residual lead A which are retracted as described above are retracted together with the slide member 67 relative to the front member 65 but not retracted relative to the slide member 67 and, therefore, a projecting length of the lead from the slide member 67 is not decreased at all.

Further, since the window 72 of the slide member 67 is engaged with the projections 70 of the chuck body 60, its retracting position is maintained even after the release of the knocking or pushing operation and, therefore, no gap or air space is produced between the succeeding lead B and the residual lead A due to, for example, a drop of the lead by gravity.

In the embodiment described above, the projections 70 of the chuck body 60 are contacted with the front end of the window 72 after the contact between the chuck ring 61 and the step portion 97, that is, after opening of the chuck body 60. Therefore, the chuck body 60 can be opened without receiving any restriction and, consequently, a pleasant "click" sound of the chuck ring can be obtained by the user.

Figure 59:
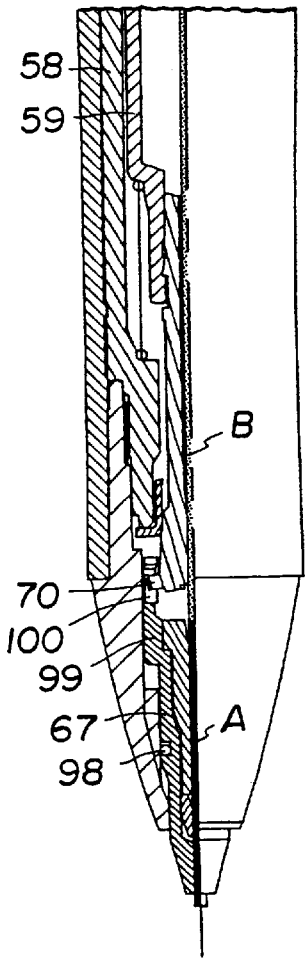
FIG. 59 is a longitudinally sectional view of a mechanical pencil according to a sixteenth embodiment of the invention.

FIG. 59 shows a sixteenth embodiment of the invention, in which the tubular portion of the slide member 67 is made of a separate member. The tubular member 99 has a window 100 for receiving freely the projections 70 of the chuck body 60. The tubular member 99 is press-fitted into the body portion of the slide member 67, and the press-fitting distance can be determined optionally.

An operation of the structure described above can be considered to be substantially same as that of the fifteenth embodiment and will be omitted for simplification but, in this embodiment, a press-fitting distance of the tubular member 99 to the body portion of the slide member 67 can be varied. Therefore, dimensional unevenness or scattering of the products and a projection length of the lead can be determined by the press-inserting distance of the tubular member to the slide member 67.

In the fifteenth and sixteenth embodiments of the invention, the rear end of the slide member is positioned in a forward position relative to the stepped portion 97 of the front member 65, and a gap is formed between the rear end of the slide member and the front end of the chuck ring. However, it may be possible that the rear end of the slide member is positioned in a rearward position relative to the stepped portion of the front member and the gap is formed between the rear end of the slide member and the front end of the chuck ring. In brief, it will be sufficient that there is a gap for retraction of the slide member while the chuck body is holding the succeeding lead. Unless the gap is formed, the chuck body is not permitted to be retracted by a normal writing pressure and, consequently, a wedging force for gripping the lead is weakened to result in an unfavorable and unexpected retraction of the lead.

Figure 62:
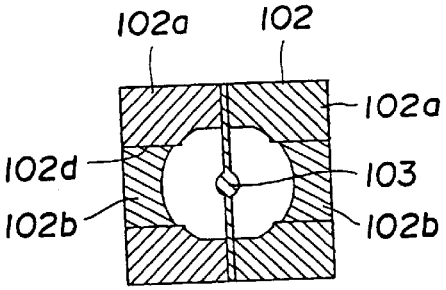
Figure 63:
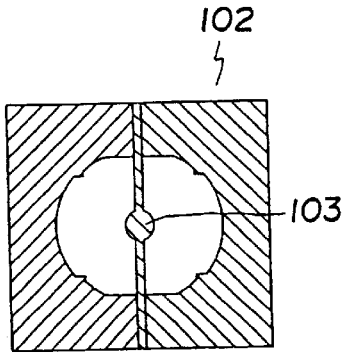

An example of a molding device for forming the chuck body will be explained with reference to FIGS. 60 to 63. The mold 101 contains therein a cavity 102 which is divided into plural portions for forming an outer shape of the chuck body 60, and a core pin (mold pin) 103 for forming an inner shape of the chuck body 60. The plural-divided cavity 102 is constituted with a cavity portion 102*a* for forming a rear portion 60*a* and a front portion 60*c* of the chuck body 60, and a cavity portion 102*b* for an inclined surface 60*b* contacting with the chuck ring 61. More specifically, a through hole 102*d* is formed at the portion where the inclined surface 60*b* of the cavity portion 102*a* is formed, and the cavity portion 102*b* which forms the inclined surface 60*b* is fitted to the through hole 102*d* (FIG. 62). In other words, the cavity portion 102*b* for forming at least the inclined surface 60*b* of the chuck body 60 can be changed or replaced. When it is desired to regulate the outer shape of the inclined surface 60*b*, only the cavity portion 102*b* is removed and replaced by another one by modifying or correcting the same.

Figure 60:
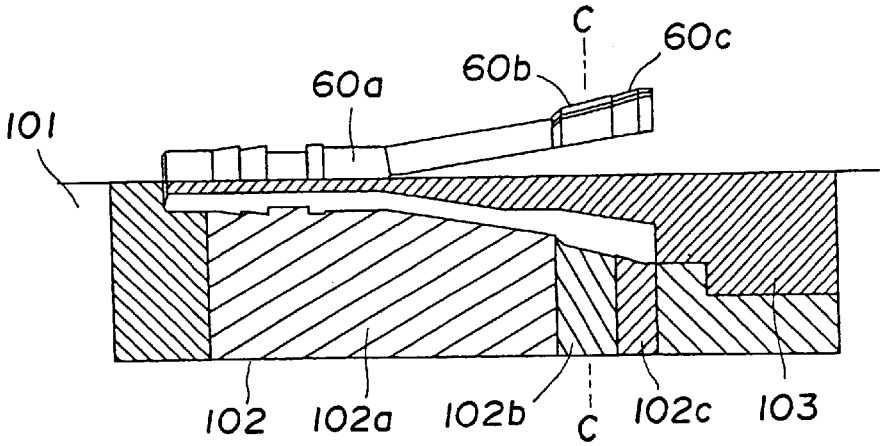
FIGS. 60 to 63 are diagrams showing an example of a molding device for forming a chuck body according to the present invention.
Figure 61:
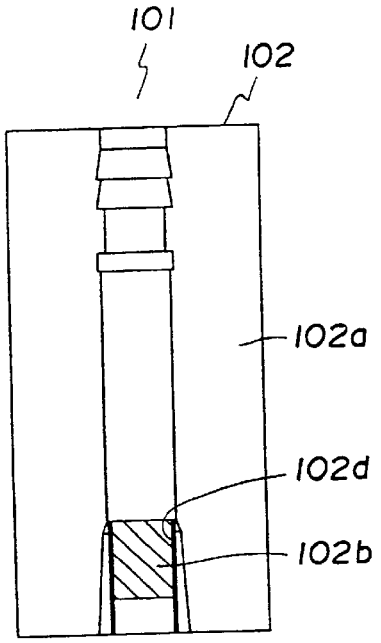

In the embodiment described above, the cavity portion 102*a* which forms the rear portion 60*a* and the front portion 60*b* of the chuck body 60 is formed in a unitary structure, but it can be formed in a separate manner as shown in FIG. 60. Specifically, it may be comprised of a cavity portion 102*a* for forming the rear portion 60*a* of the chuck body 60, a cavity portion 102*b* for forming the inclined surface 60*b* and a cavity portion 102*c* for forming the front portion 60*c*. Namely, it can be constructed such that the cavity portion 102*a* is divided into two.

In the structure that the chuck body and the slide member are operationally interconnected with each other as described above, the timing is very important between the time when the chuck body is retracted to retract the slide member and the time when the chuck body is closed by the chuck ring. Therefore, an accuracy of the inclined surface of the chuck body is required. In this respect, the chuck body which is made by the mold described above will provide an accurate regulation of the inclined surface of the chuck body quite easily and economically.

Figure 64:
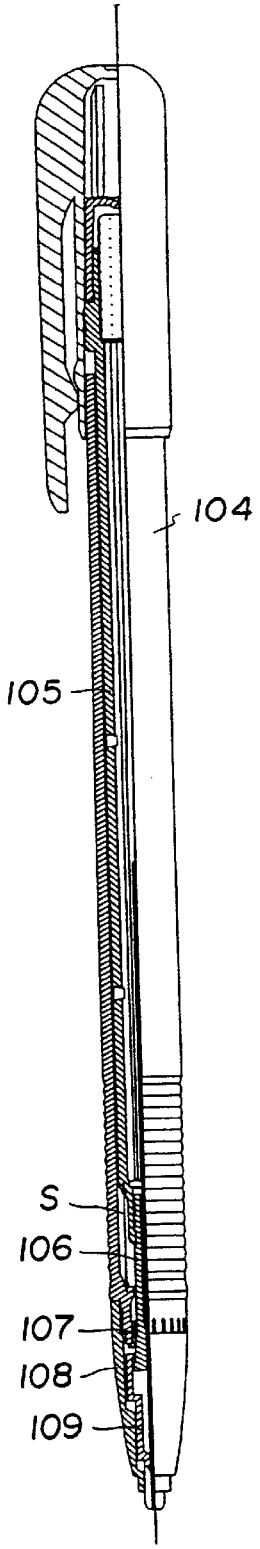
FIG. 64 is a longitudinally sectional view of a mechanical pencil according to a seventeenth embodiment of the invention.
Figure 65:
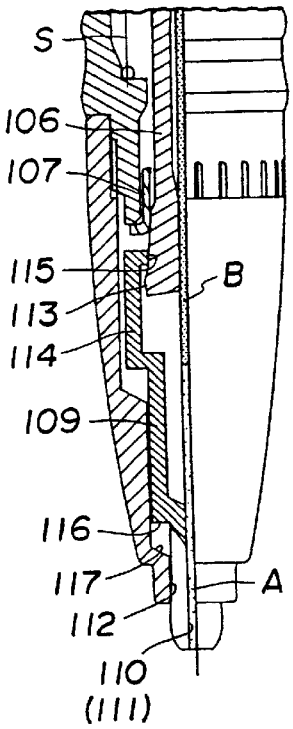
FIGS. 65 to 67 are enlarged views of the part shown in FIG. 64, showing an operational mode.

FIGS. 64 and 65 show a seventeenth embodiment of the invention in which a lead gripping member is provided at an end of the slide member. In the tubular shaft 104, the lead tank 105 having a first chuck body 106 at its front end is axially movably disposed. At the front of the first chuck body 106 is provided a chuck ring 107 which serves to close/open the chuck body 106.

A front member 108 is releasably engaged with the end of the tubular shaft 104 by means of, for example, a threading engagement means but the front member 108 can be integrally formed with the tubular shaft 105. The chuck body 108 contains therein a second chuck body 109 which is axially movable in the front member 108. The second chuck body 109 has a lead holding portion 110 having on its inner surface a lead griping portion 111 for softly hold the lead. The lead gripping portion 111 is formed integral with or otherwise separately from the second chuck body 109. In other words, when the second chuck body 109 is fully closed, it holds or grasps firmly the lead and, on the other hand, when it is opened, it holds the lead softly. Incidentally, if the lead gripping portion 111 is formed in a unitary structure, the lead holding portion 110 can be processed with embossing or tapping on the inner surface thereof and, if it is formed of different members, a resilient material such as a silicone rubber, NBR or the like is adhered thereto.

The second chuck body 109 has a front portion which projects from the end of the front member 108, and the end portion of the front member 108 serves as a chuck ring 112 for opening/closing the second chuck body 109.

In FIG. 64 of the drawing reference character "S" represents a resilient member such as a coil spring for spring-biasing the first chuck body and the lead tank 105.

A further description will be made with respect to the first chuck body 106 and the second chuck body 109. The first chuck body 106 has, on its front outer circumference, an outer flange portion 113. The second chuck body 109 has at its rear portion a tubular portion in a continued manner, and the tubular portion 114 has, at its inner rear end, an inner flange portion 115 which contacts with the outer flange portion 113 of the first chuck body 106. The second chuck body 109 has, on its front outer circumference, a middle stepped portion 116 so that it (116) contacts the inner stepped portion 117 of the front member 108.

The first chuck body 106 is of collet type having two-split, three-split or four-split structure in which if it is forcibly and firmly closed while it grasps no, lead at all, the outer flange portion 113 of the first chuck body 106 is released out of the inner flange portion 115 of the of the second chuck body 109. In other words, the first chuck body 106 and the second chuck body 109 can be assembled with, and disassembled from, each other.

An operation will be described. FIG. 65 shows the state that a residual lead A which has been left from the first chuck body 106 is held by the second chuck body 109. Further, the succeeding lead B is held by the first chuck body 106. When the lead tank 105 is pushed forward, the first chuck body 106 is advanced together with the chuck ring 107 so that also the succeeding lead B is advanced. Along with the advance of the succeeding lead B, the residual lead A is pushed forward. However, since the residual lead A is held by the holding portion 110 of the second chuck body 109, and since the inner flange portion 115 of the second chuck body 109 is contacted with the outer surface of the first chuck body 106, the second chuck body 109 is advanced together with the residual lead A.

At this moment, when the second chuck body 109 is advanced a little (that is, more or less), the second chuck body 109 is opened but, since the lead is held softly by the lead holding portion 109 even when the second chuck body 109 is opened and, therefore, the second chuck body 109 is advanced by the advancing movement of the residual lead A. Incidentally, when the middle stepped portion 116 of the second chuck body 109 is contacted with the inner stepped portion 117 of the front member 108, the second chuck body 109 is restricted from its further advancing movement.

Figure 66:
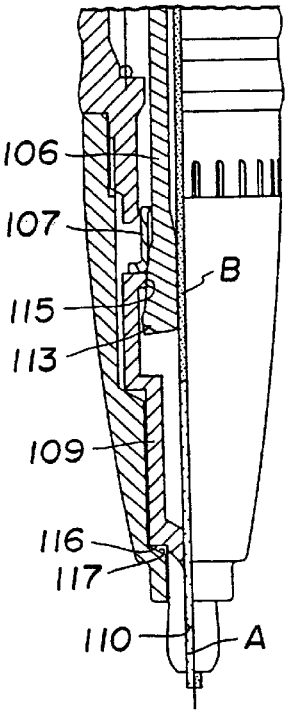

When a further advancing movement is made by the lead tank 105, the residual lead A is pushed by the succeeding lead B and further slidably advanced through the lead gripping portion 111 of the second chuck body 109 which has been restricted from its movement so that the residual lead A is projected from the end of the lead gripping portion 111. In a short time, the chuck ring 107 is contacted with the rear end of the second chuck body 109 and its further advancing movement is limited, so that the first chuck body 106 is opened to release the succeeding lead B (FIG. 66).

Figure 67:
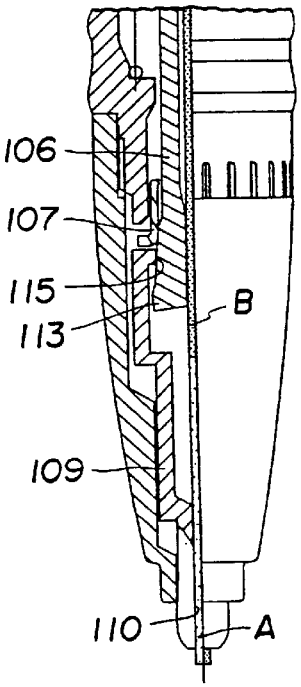
Figure 68:
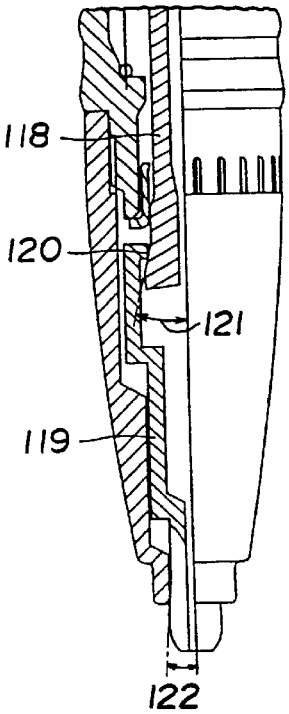
FIG. 68 is a sectional view of a part of the mechanical pencil according to a eighteenth embodiment of the invention.

When the advancing movement of the lead tank 105 is released (that is, terminated), the first chuck body 106 is retracted releasing the succeeding lead B and, in the process of the retraction, the outer flange portion 113 of the first chuck body 106 is contacted with the inner flange portion 115 of the second chuck body 109 to thereby retract also the second chuck body 109. In this state, since the residual lead A is softly held by the lead gripping portion 111 of the second chuck body 109, it is retracted together with the second chuck body 109 with the projected position of the residual lead A being maintained, and the residual lead B which is released from the first chuck body 106 is retracted (FIG. 67).

Then, the first chuck body 106 is closed by the chuck ring 107 to retract the succeeding lead B.

By the operation described above, the residual lead A is retracted relative to the front member 108 but, since the residual lead A is retracted together with the second chuck body 109, a projecting length of the residual lead A is not decreased.

Figure 58:
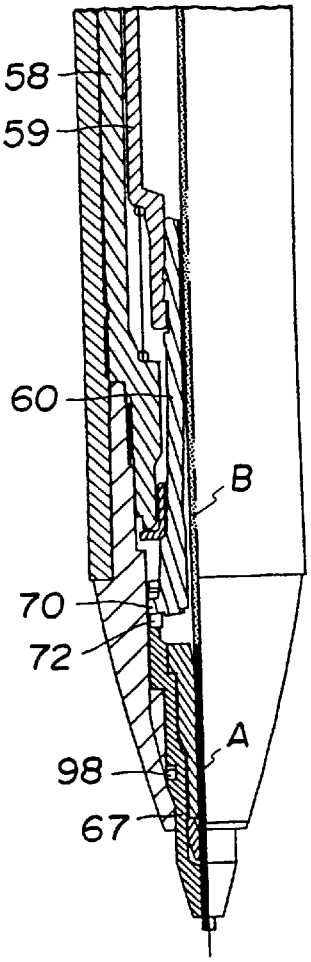

FIG. 58 shows an eighteenth embodiment of the invention. A conical angle 121 of an outer circumference of a first chuck body 118 which contacts an inner flange portion 120 of a second chuck body 119 is determined to be larger than an conical angle 122 of the outer circumference of the end portion of the second chuck body 119. By varying the conical angles of the first chuck body and the second chuck body as described above, unevenness of the holding positions of the lead by each of the chuck bodies can be absorbed. For example, when the first chuck body is made of a resin material, an outer diameter of the first chuck body is decreased due to elasticity fatigue, etc. and, as a result, the second chuck body which is positioned at a relatively forward position is retracted more than an initially determined position. Consequently, it provides a bad effect on the lead gripping force. This problem has been solved by changing the conical angles of the first chuck body and the second chuck body in the present embodiment.

With respect to the conical angles described above, it may be possible that the conical angle relation in the eighteenth embodiment described above be changed in the opposite relation. Namely, the conical angle of the first chuck body 118 is set smaller and the conical angle of the second chuck body 119 is set larger. The eighteenth embodiment will work effectively if the first chuck body is made of a metal and the second chuck body is made of a resin material. This will permit that a lead gripping force of the second chuck body becomes larger than the first chuck body, so that a shake or swing of the lead at its extended tip portion can be prevented.

Figure 69:
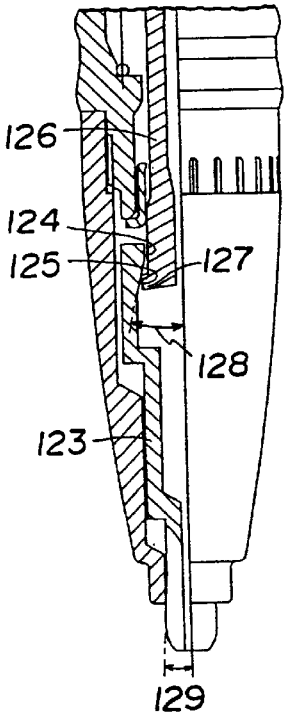
FIG. 69 shows a modification of the chuck body of the seventeenth embodiment of the invention.
Figure 70:
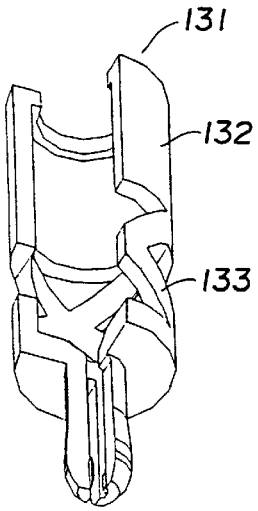
FIGS. 70 to 73 show further modifications of the chuck body according to the seventeenth embodiment of the invention.
Figure 71:
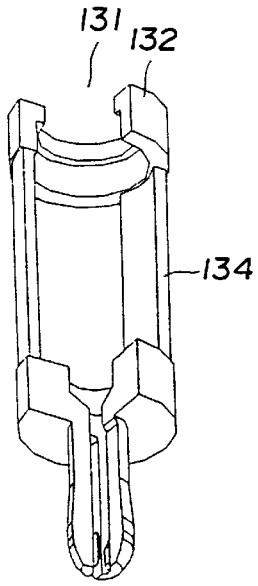
Figure 72:
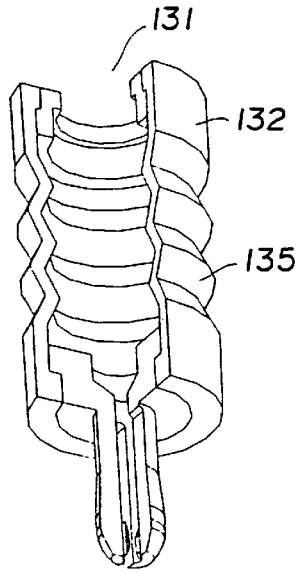
Figure 73:
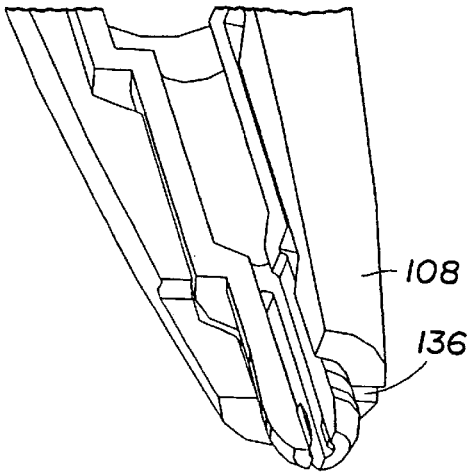

FIG. 69 shows another example in which the second chuck body 123 has, on its inner flange portion 124, a conical portion 125 so that it contacts with the outer flange portion 127 of the first chuck body 126. It is the matter of course that the conical angle 128 of the first chuck body 126 is different from the conical angle 129 of the second chuck body 123. There will be many other modifications. In an example of FIG. 70, the second chuck body 131 is provided, at its middle of the tubular portion 132, with a flexible stitch portion 133 which, however, can be replaced by rubber-like resilient body 134 (FIG. 71) by a two-color molding technique (molding technique of different material). Further, as shown in FIG. 72, a bellows-like structure 135 can be formed. In another alternative, as shown in FIG. 73, a slit is formed at a tip of the front member 108 so that the slit portion can be opened, and the closed position of the second chuck body is made changeable to thereby absorb the unevenness or scattering of the gripping position of the lead.

In the various examples described above, the slide member (and second chuck body) is retracted by the chuck body (and first chuck body) but other features can be applied.

Hereinafter, a nineteenth embodiment of the invention will be described with reference to FIGS. 74 and 75, for example. The tubular shaft 137 contains therein an axially displaceable lead tank 138 which has at its front end a chuck body 139. On the front end portion of the chuck body 139 is provided a chuck ring 140 for opening/closing the chuck body. A resilient member 5 such as a coil spring is disposed between the lead tank 138 and the inner stepped portion 142 of the tubular shaft 137 for the purpose of spring-biasing the elements such as the chuck body 139. Thus, a lead feed mechanism 143 of the present invention will be composed of these elements such as the lead tank 138, chuck body 149, chuck ring 140 and the resilient member 141.

Figure 76:
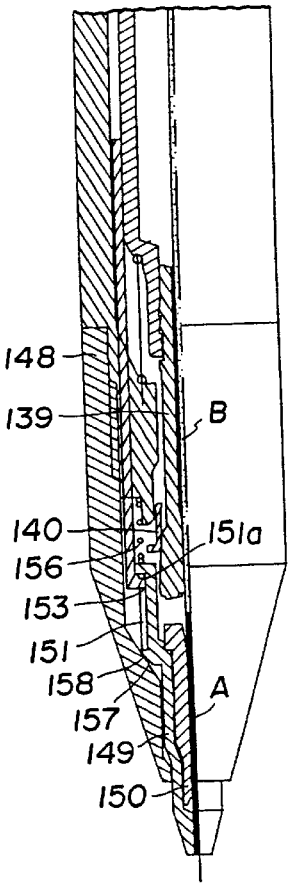
FIGS. 76 to 79 are sectional views showing an operational mode of the structure of the nineteenth embodiment of the invention.

A front member 148 is threadedly engaged with the front portion of the tubular shaft 137, and the front member 148 contains therein an axially movable slide member 149 projecting from the end of the front member 148. The slide member 149 has, independently or otherwise unitarily, an anti-retraction member 150 which prevents the lead from retracting. On the outer surface of the two confronting spots of the slide member 149, a groove portion 151 is formed. The groove portion 151 is not extended to the rear end of the slide member 149 but terminated en route or on the half way, and a stop portion 151*a* is formed as illustrated in FIGS. 74 and 76, for example.

The lead tank 138 has at its front portion an arm portion 152 in an opposed relation and the arm portion 152 has an inner projection 153 at its front end portion. In the illustrated embodiment, the arm portion 152 and the lead tank 138 are made of separate members but they can be made in a unitary structure if desired. The inner projection 153 comes into a slidable engagement with the groove 151 of the slide member 149. The arm portion 152 is slidably fitted into a slit 155 on an inner reduced-diameter portion 154 of the tubular shaft 137, so that swinging or bending in a circumferential direction can be prevented (see particularly FIG. 75).

A resilient member 156 such as a coil spring is disposed between the tubular shaft 137 and the slide member 149 for spring-biasing the slide member 149 all the time.

An operation will be described. FIG. 74 shows the state that the residual lead A left from the chuck body 139 is held by the anti-retraction member 150 and the succeeding lead A is held by the chuck body 139. The slide member 149 is spring-biased forwardly by the resilient member 156 but, since the inner projection 153 of the arm member 152 from the lead tank 138 is contacted with the rear portion of the groove portion 151 of the slide member 149, a forward movement of the slide member 149 is restricted.

When the lead tank 138 is pushed forward, the chuck body 139 is retracted together with (lie chuck ring 140. However, since the slide member 149 is spring-biased by the resilient member 156, the slide member 149 is advanced with the engagement being maintained between the inner projection 153 of the arm portion 152 and the rear portion of the groove portion 151. Consequently, the succeeding lead B held by the chuck body 139 and the residual lead A held by the anti-retraction member 150 are advanced together with the slide member 149. Then, the middle stepped portion 157 of the slide member 149 is contacted with the inclined wall 158 of the front member 148 to limit the further advancing movement (FIG. 76).

Figure 77:
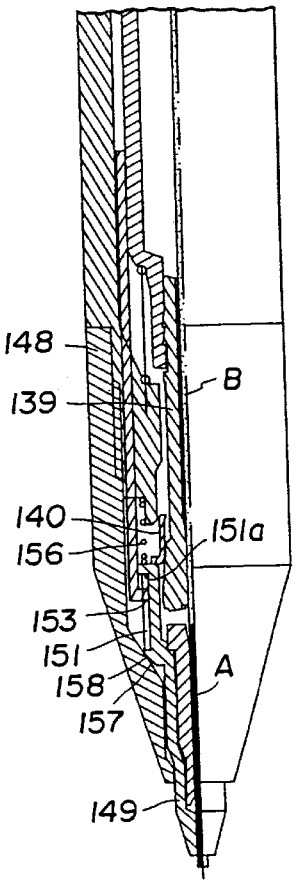
Figure 78:
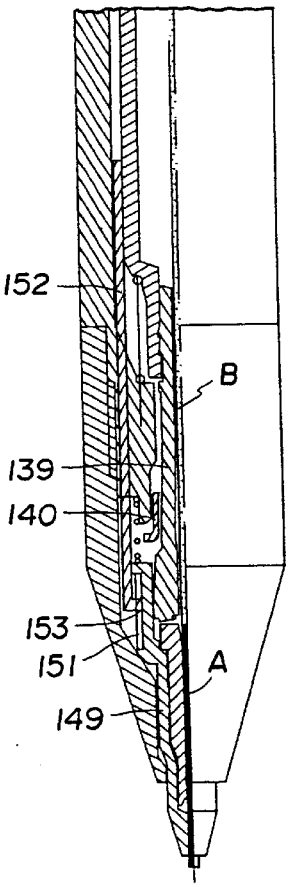

Now, the inner projections 153 of the arm portion 152 is movably inserted into the groove portion 151 of the slide member 149 and therefore the inner projection 153 of the arm portion 152, the chuck body 139, the chuck ring 140, the succeeding lead B and the residual lead A which are held by the chuck body 139 can be advanced further (FIG. 77). However, the chuck ring 140 is restricted from further movement at the time when it abuts against the rear end of the slide member 149. At this moment, the chuck body 139 is opened so that the engagement of the succeeding lead B is released (FIG. 78).

Figure 79:
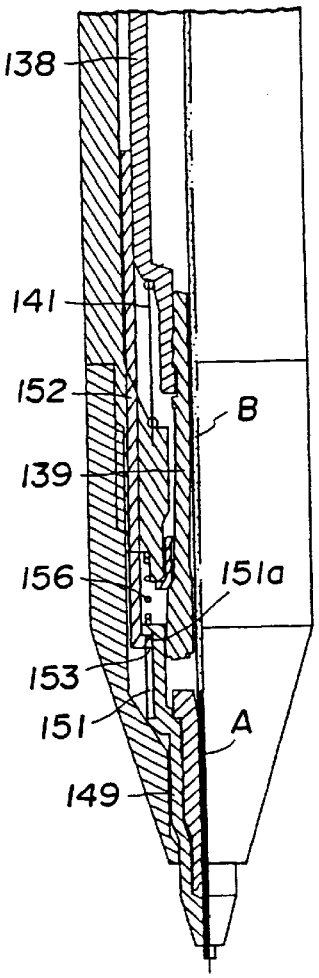

When the forward movement (i.e., advance) of the lead tank 138 is released, the chuck body 139 is retracted while it is opened, and the slide member 149 which is spring-biased by the resilient member in the forward direction is not retracted. When the inner projection 153 of the arm portion 152 is contacted with the stop portion 151*a* of the groove portion 151 of the slide member 149, the slide member 149 starts retracting (FIG. 79) against a resilient force of the resilient member 156.

Figure 74:
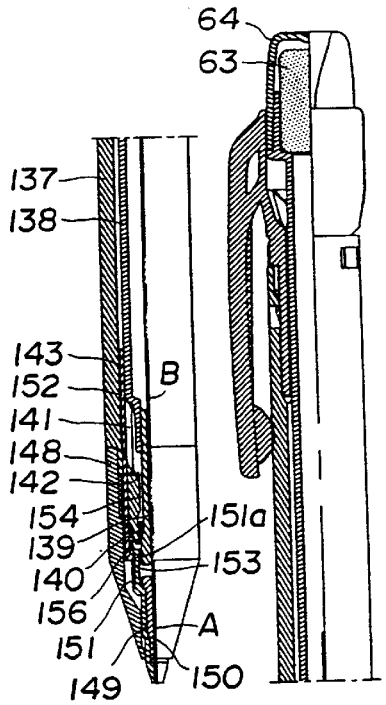
FIG. 74 is a longitudinally sectional view of a mechanical pencil according to a nineteenth embodiment of the invention.
Figure 75:
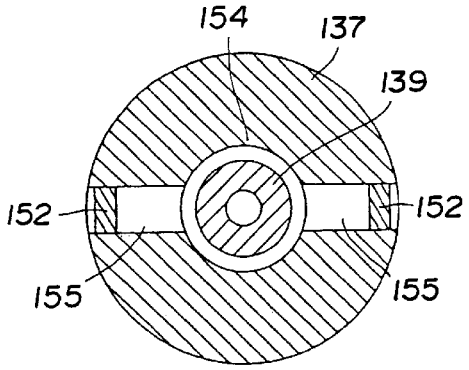
FIG. 75 is a sectional view of the portion shown in FIG. 74.

In a short time, the chuck body 139 is closed by the chuck ring 140 to grasp the succeeding lead B again (FIG. 74). At this moment, chuck body 139 will be retracted with holding therein the succeeding lead B in a similar manner as the conventional prior art technique. However, also the slide member 149 is retracted and therefore no gap is produced between the succeeding lead B and the residual lead A.

Although the succeeding lead and the residual lead are retracted by the operation described above, but the leads are retracted together with the slide member 149 relative to the front member 148 and, therefore, they are not retracted relative to the slide member 149. Consequently, a lead projection length from the end of the slide member 149 is not at all decreased.

Further, the slide member 149 which is engaged with the inner projection 153 of the arm portion 152 maintains its retracting position even after release of the pushing operation and, therefore, no space or gap is produced between the succeeding lead B and the residual lead A due to, for example, drop by gravity.

Figure 80:
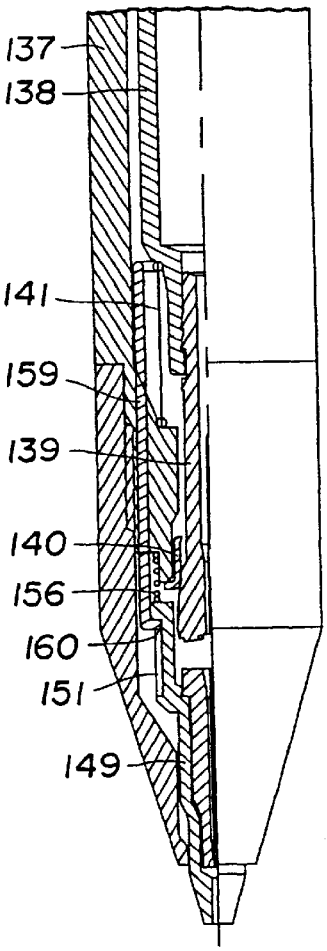
FIG. 80 is a sectional view showing a modification of the nineteenth embodiment shown in FIG. 74.

A modification of the nineteenth embodiment of the invention will be described with reference to FIG. 80. Although in the previous embodiment the arm portion is fixed to the lead tank to thereby provide an interlocking relation, in the present embodiment of FIG. 80, the slide member is interconnected by the resilient member 141. Specifically, a forwardly bent arm portion 159 is extended from a rear end of the resilient member 141, and a front end portion (inner projection 160) of the arm portion 159 is engaged with a stop portion 151*a* of the groove portion 151.

By working or processing the resilient member itself, the arm portion can be formed and, therefore, an easy and economical assembly can be attained. A further description of the operation will be omitted for simplification only since it is considered to be substantially same as the previous embodiments.

Figure 81:
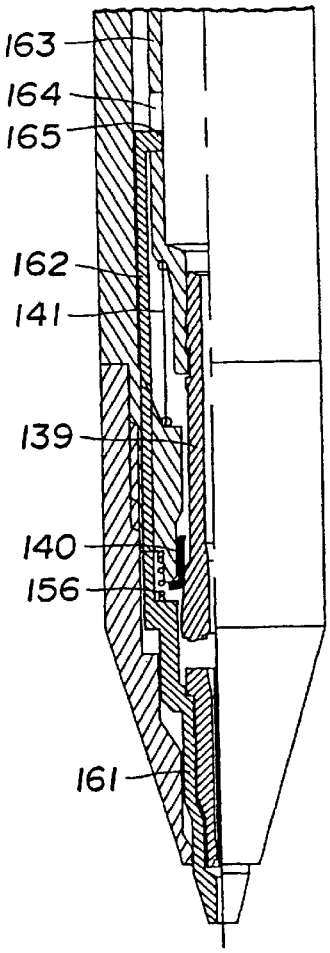
FIG. 81 is a sectional view showing another modification of the nineteenth embodiment of the invention.

FIG. 81 shows a further modification in which an arm portion 162 is extended rearward from the slide member 161 and the arm portion 162 is slidably engaged with a slit 164 of the lead tank 163 to thereby provide an interconnecting relation.

An operation will be described except the operational mode that is substantially same as the previous (nineteenth) embodiment. When the lead tank 163 is pushed, the chuck body 139 and the chuck ring 140 are advanced and at this moment the slide member 161 is advanced by a resilient force of the resilient member 156. When the advance of the slide member 161 is released, only the chuck body 139 and the chuck ring 140 are advanced and, in a short time, the chuck body 139 is opened. At this moment, the slit 164 of the lead tank 163 is slidably advanced relative to the inner projection 165 of the arm portion 162. When the pushing operation of the lead tank 163 is released, not only the lead tank 163 but also the chuck body 139 start their retraction. At this moment, the slider member 161 is not moved rearward by the resilient member 156 but, in a moment of so, the arm portion 165 is contacted with the front portion of the slit 164 of the lead tank 163 and, by this contact, the slide member 161 is forcibly retracted.

Figure 82:
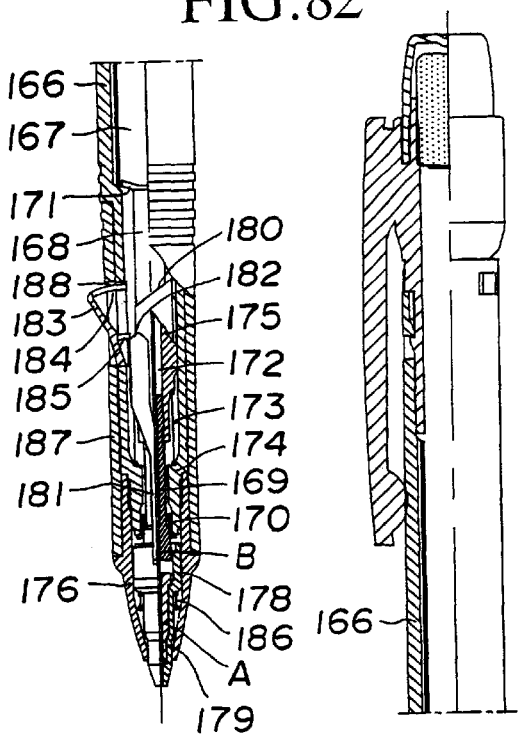
FIG. 82 is a sectional view of a mechanical pencil according to a twentieth embodiment of the invention.

FIG. 82 shows a twentieth embodiment of the present invention in which the invention is applied to a so-called side knock type mechanical pencil having a knocking or pushing operational button on the side of the tubular shaft of the pencil. A tubular shaft 166 has a lead tank portion 167 at the rear portion but the lead tank portion may be formed at a rear of a lead feeding mechanism which will be described.

In a front inner portion of the tubular shaft 166, a tapered slide member 168 is axially slidably disposed. A chuck ring 170 is provided around a front portion of the chuck body 169 for opening/closing the chuck body 169. At the rear end of the tapered slide member 168, a lead receiving member 171 is fixed to, or unitarily formed with, the rear end of the tapered slide member so that the leads can be divided one by one and received the lead receiving member 171. An inner diameter of a lead passage 172 of the tapered slide member 1698 is determined to be larger than the diameter of the lead, so that any obstruction against passing of the lead, which is caused by curvature of the tapered slide member of curvature of the lead, can be prevented effectively.

A resilient member 173 such as a coil spring which spring-biases the tapered slide member 168 and the chuck body, etc. in the rearward direction is disposed between the tapered slide member 168 and the inner stepped portion 174 of the tubular shaft 166. These elements such as the tapered slide member 168, chuck body 169, chuck ring 170 and resilient member 173 constitute the lead feed mechanism 175 of the present invention.

A front member 176 is releasably engaged with a front portion of the tubular shaft 166 by, for example, a threaded engagement. The front member 176 has a slide member 178 which is slidably disposed in the front member and projects from an end of the front member 176. The slide member 178 has therein an anti-retraction member 179 which holds the lead softly for preventing the lead from dropping. The anti-retraction member 179 may be formed integral with the slide member 178.

The tapered slide member 168 has an inclined surface 180 on an outer surface of the middle portion thereof. An arm portion 181 is fixed to a rear portion of the slide member 178 and the arm portion 181 has at its rear portion an inclined surface 182 which is shorter than the inclined surface 180. A knock member 183 is rotatably positioned at a middle portion of the tubular shaft 166 and the knock member 183 has a first contact portion 184 and a second contact portion 185 which will contact with the inclined surfaces 180, 182, respectively. Incidentally, the contact portions 184, 185 of the knock member 183 are formed to ride over the tapered slide member 168 so that they can contact with the inclined surfaces 180, 182.

Reference numeral 186 represents a resilient member such as a coil spring which is disposed between the front member 176 and the slide member 178 for spring-biasing the slide member 178 in the rearward direction.

Further, reference numeral 187 represents a grip member of a rubber-like material which is coated extending from a front portion of the tubular shaft 166 to a rear portion of the front member 176. At the middle portion where the grip member 187 meets with the tubular shaft 166, a window 188 is formed for permitting the knock member 183 to rotate about, as a fulcrum, the front end thereof.

An operation will be explained. FIG. 82 shows the state that the residual lead A which has been left from the chuck body 169 is held by the anti-retraction member 179 and the residual lead B is held by the chuck body 169. The slide member 178 is spring-biased in the rearwardly by resilient member 186, and its rear end (that is, the inclined surface 182) is contacted with the second contact portion 185 of the knock member 183 and, therefore, a retraction of the slide member 178 is restricted. Incidentally, the first contact portion 184 of the knock member 183 is, in a normal condition, not contacted with but spaced from the inclined surface 180 of the tapered slide member 178. By forming the spaced relation as described above, a reliable grasping force of the chuck body relative to the lead can be maintained even if there is an inadvertent or unexpected dimensional reduction of the lead during the production steps of the lead. On the other hand, if the tapered slide member is always placed in a close contact position relative to the knock member, the gripping force becomes lowered and, therefore, it is likely that the lead is unfavorably depressed in the writing operation.

Figure 83:
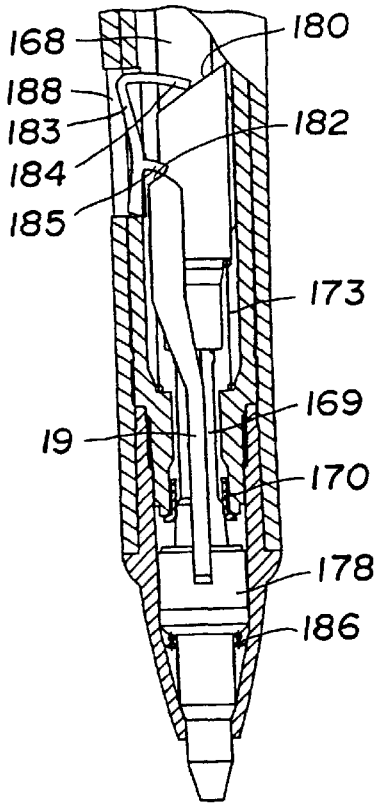
FIGS. 83 to 86 show an operational mode of the pencil of the twentieth embodiment shown in FIG. 82.

When the knock member 183 is pushed inside of the tubular shaft in the radially inwardly, the second contact portion 185 of the knock member 183 pushes the inclined surface 182 of the slide member 178 so that the slide member is advanced. At this moment, the residual lead A is held by the anti-retraction member 179 of the slide member 178 and, therefore, the residual lead A is retracted together with the slide member 178. When the knock member 183 is pushed further, the first contact portion 184 of the knock member 183 comes into contact with the inclined surface 180 of he tapered slide member 168 to thereby start an advancing movement of the tapered slide member 168. At this moment, however, the second contact 185 of the knock member 183 has over-ridden a top of the inclined surface 182 of the slide member 178 and, therefore, the slide member is not permitted to advance further. Thus, even if the knock member 183 is pushed further, the position of the knock member is unchanged (FIG. 83).

When the advancing movement of the tapered slide member starts, the chuck body 169 which holds the succeeding lead B and the chuck ring 170 are moved forward.

Figure 84:
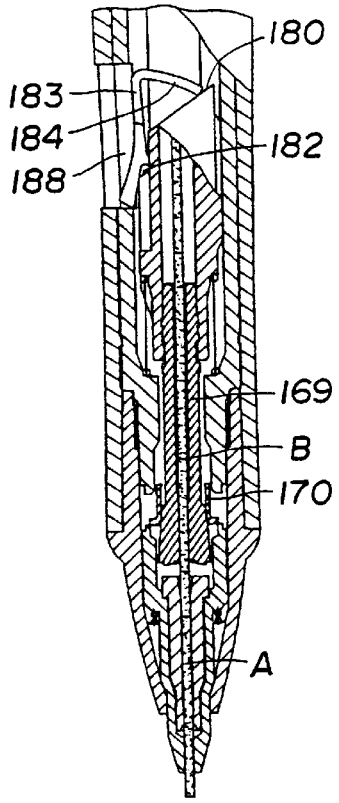

In the forward movement of the chuck body 169, the succeeding lead B held by the chuck body 169 contacts and immediately pushes the residual lead A, so that the residual lead A is advanced relative to the slide member 178 (FIG. 84). In a short time, the chuck ring 170 contacts the rear end of the slide member 178 to open the chuck body 169 so that the engagement with the succeeding lead is released. Although in this step the slide member 178 is spring-biased by the resilient member in the rearward direction but retraction of the slide member 178 is restricted because the top of the inclined surface 182 is contacted with the second contact portion 185 of the knock member 183.

An advancing movement distance of the tapered slide member 168 by the first contact portion 184 of the knock member 183 is larger than an advancing movement of the slide member 178 by the second contact portion 185. In other words, it is designed that the tapered slide member advances more than the slide member. Specifically, a length of the inclined surface 180 of the tapered slide member 168 is made longer than a length of the inclined surface 182 of the slide member 178 so that the advancing distance is longer as described above.

Figure 85:
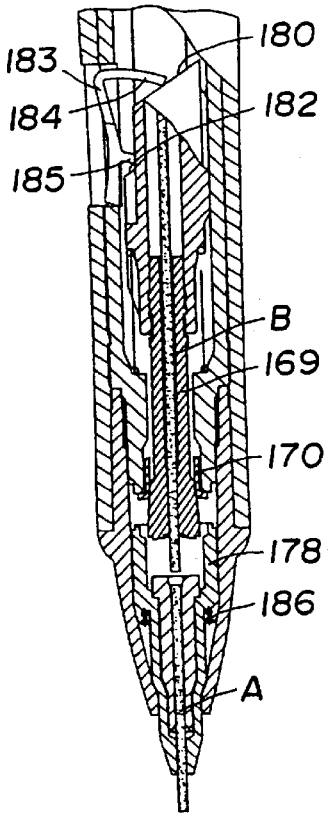

When the pushing operation of the knock member 183 is released, the tapered slide member 168 is retracted in the first place, so that the chuck body 169 and the chuck ring 170 are retracted and hold again the succeeding lead B to finish the retracting operation. However, since the second contact portion 185 of the knock member 183 is in the state of pushing the inclined surface 182, the slide member 178 maintains its advanced position. At this moment, the succeeding lead B is held immediately before the chuck body 169 is completely closed and retracted and, therefore, it will retract slightly so that, as a result, a gap is produced relative to the residual lead A (FIG. 85).

Figure 86:
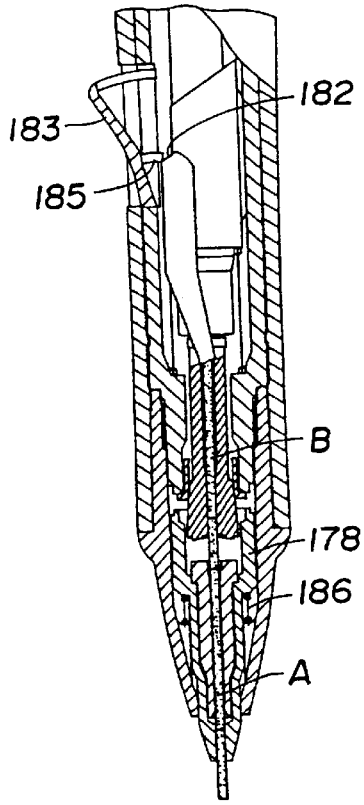

When the pushing operation of the knock member 183 is released, the second contact portion 185 of the knock member 183 rides over again the top of the inclined surface 182, and also the slide member 178 is retracted together with the residual lead A by a resilient force of the resilient member 186. At this moment, the rear end of the residual lead A is contacted with the front end of the succeeding lead B (FIG. 86).

In this embodiment, the tapered slide member starts moving to open the chuck body after the advancing movement of the slide member is restricted. It may be possible that the tapered slide member starts in the process of the advance of the slide member, and the chuck ring catches up the rear end of the slide member to thereby open the chuck body.

In other words, it can be determined that the slide member is retracted for at least a distance which is equal to the lead-retraction length or more, after the chuck is closed, when the chuck body hold the lead. This will be able to omit a means or mechanism which restricts the advancing movement of the slide member.

Figure 87:
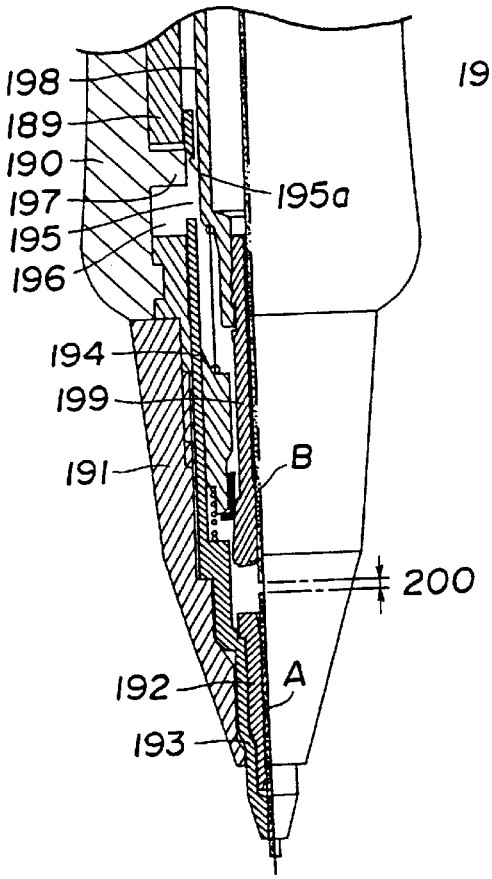
Figure 88:
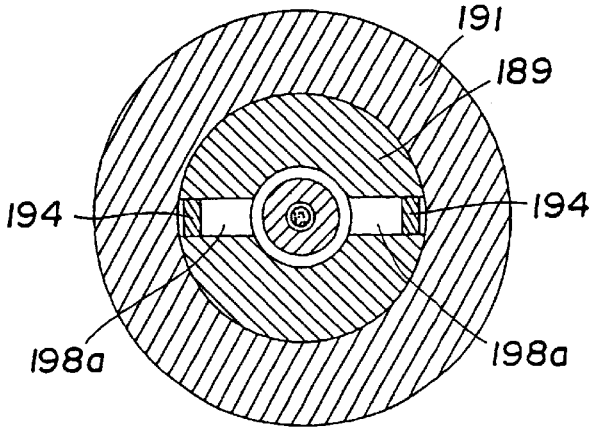

FIGS. 87 and 88 show a twenty first embodiment of the invention, in which the slide member is retracted by pushing a grip member which is provided on the tubular shaft. The grip member 190 made of a rubber-like resilient material is mounted on the front outer circumference of the tubular shaft 189. A front member 191 is threadedly engaged with a front end of the tubular shaft 189 and a slide member 193 having therein an anti-retraction member 192 is axially slidably disposed in the front member 191. An arm portion 194 is formed on the rear portion of the slide member 193 such that the arm portion 194 is slidably engaged with a slit 198*a* of the tubular shaft 198, and the arm portion 194 has an engagement hole 195 at is rear end. The engagement hole 195 has an inclined surface 195*a* on its rear portion. A through hole 196 is formed on the tubular shaft 189 at a confronting position of the engagement hole 195, and an inner projection 197 of the grip member 190 is movably inserted into the through hole 196. A chuck body 199 is fixed to the front end of a lead tank 198.

Figure 89:
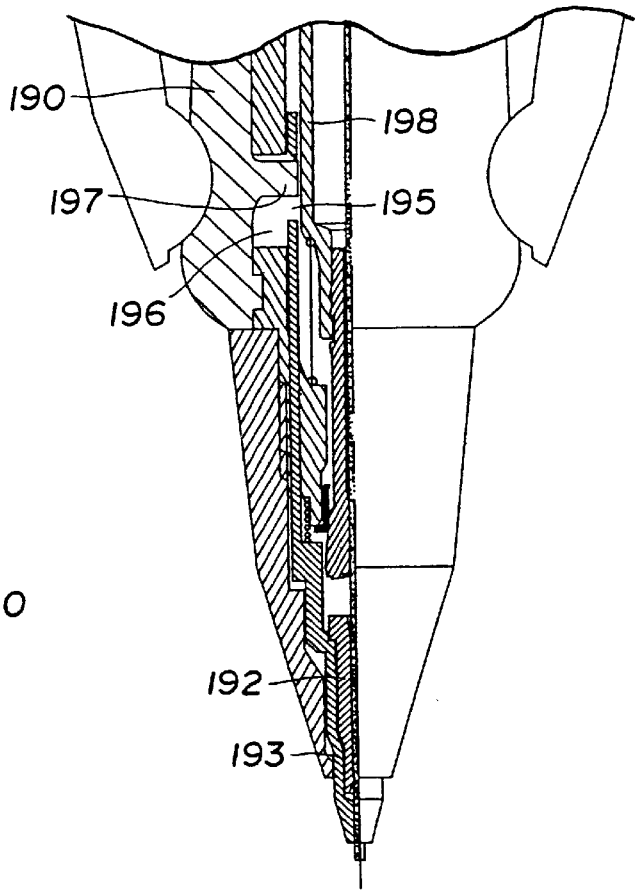

An operation will be described. FIG. 87 shows the state that the lead tank 198 is pushed to proceed a lead feed operation. Similarly to the prior art structure, a space or gap 200 is formed between the residual lead A and the succeeding lead B. When the grip member 190 is grasped for writing purposes, the grip member 190 is inwardly deformed or depressed by the grasping force of the user, and the inner projection 197 serves to retract the arm portion 194 by sliding along the inclined surface 195*a* of the arm portion 194. At this moment, also the slide member 193 is retracted and consequently the rear end of the residual lead A is contacted with the front end of the succeeding lead B (FIG. 89)

Figure 90:
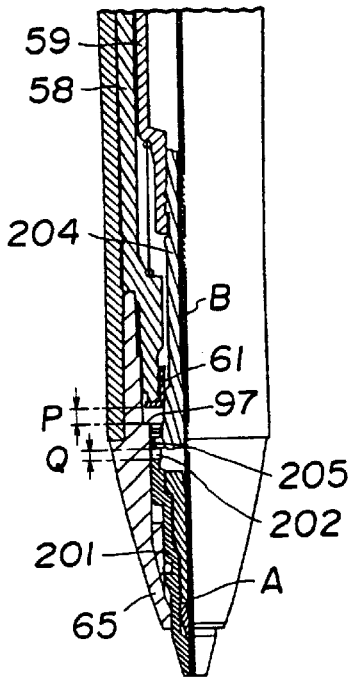
FIGS. 90 to 93 are sectional views showing the structure according to a twenty-second embodiment and also showing an operation thereof.

FIG. 90 shows a twenty second embodiment of the invention which is a modification of the fifteenth embodiment. In this embodiment, a distance P of the movement until the chuck ring contacts the stepped portion is made larger than a distance Q of the movement until the projection of the chuck body contacts the front end of the window of the slide member. Similarly to the fifteenth embodiment of the invention, the slide member 201 has at its rear end a window 202 which freely receives therein a projection 205 of the chuck body 204.

On the inner surface of the front member 65 fixed to the front end of the tubular shaft 58, a stepped portion 97 to which the chuck ring 61 contacts is provided. A movement distance P of the chuck ring 61 is determined to be larger than a movement distance 0 until the projection 205 of the chuck body 204 contacts the front end of the window 202 of the slide member 201. Further, a sliding resistance force of the slide member 201 relative to the front member 65 is determined to be larger than a sliding resistance force of the lead relative to the anti-retraction member 96.

Figure 91:
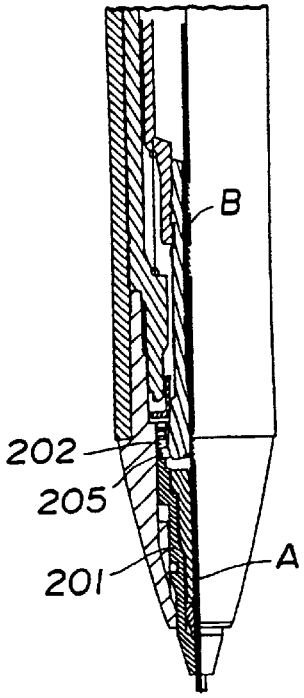
Figure 92:
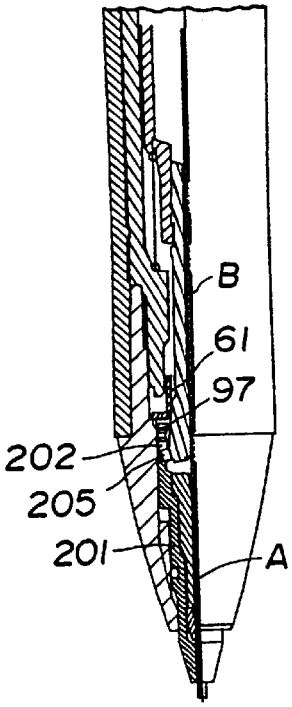
Figure 93:
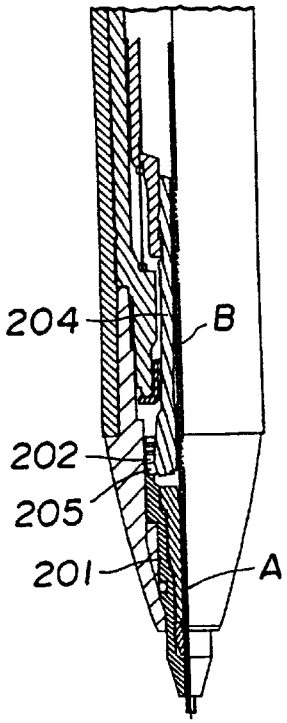
Figure 94:
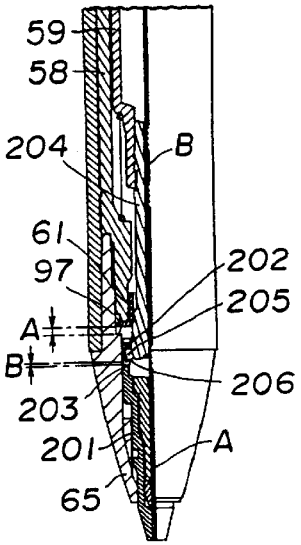
FIGS. 94 to 99 are sectional views of a part of a mechanical pencil, showing a modification of the twenty-second embodiment of the invention.
Figure 95:
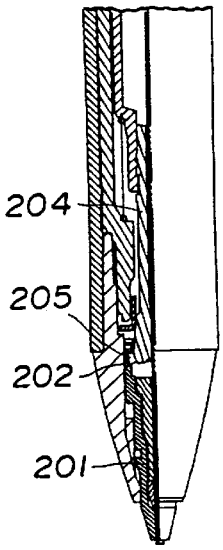

An operation will be described. When the lead tank 59 is pushed, the chuck body 204 is pushed together with the succeeding lead B and, by this movement, the residual lead A is also pushed forward. In a short time, the projection 205 of the chuck body 204 is contacted with the front end of the window of the slide member 201 (FIG. 91) to thereby makes the slide member 201 move forward. (FIG. 92). Further, when the lead tank 59 is pushed, the chuck ring 61 is contacted with the stepped portion 97 and the chuck body 204 urges the slide member in the forward direction and, at the same time, open the chuck body 204 to thereby release the engagement of the succeeding lead B (FIG. 93).

When the pushing force of the lead tank is released, the chuck body 204 is retracted and, with some delay time, the chuck body 204 is further retracted together with the slide member 201 so that the chuck body is closed by the effect of the chuck ring 61.

FIGS. 94 to 99 show a modification of the twenty second embodiment described above, in which the slide member 201 has at its rear portion a window 202 having an inclined surface 203 at the front end portion of the window 202. A projection 205 of the chuck body 204 is freely inserted into the window 202, and the window 202 has at its front end an inclined surface 206 which slidably contacts the inclined surface 203 of the window 202.

On the inner surface of the front member 65 fitted to the front end of the tubular shaft 58, a stepped portion 97 to which the chuck ring 61 contacts is provided. A moving distance P of the chuck ring 61 is determined to be larger than a distance Q of the movement until the projection 205 of the chuck body 204 is contacted with the front end of the window 202 of the slide member 201.

Figure 96:
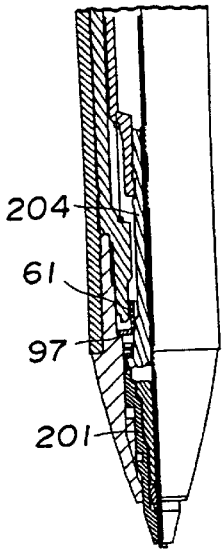
Figure 97:
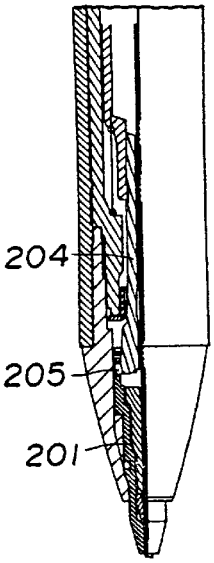
Figure 98:
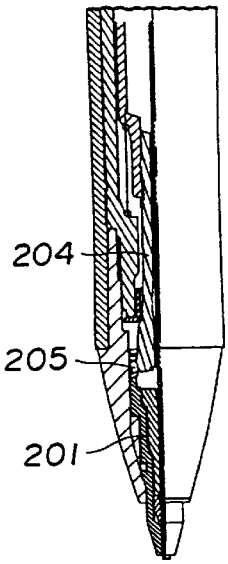
Figure 99:
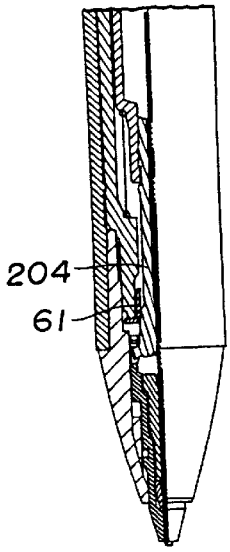

An operation will be described When the lead tank 59 is pushed, the chuck body 204 is pushed together with the succeeding lead B and, by the movement, also the residual lead A is pushed forward. In a short time, the inclined surface 206 of the chuck body 204 is contacted with the inclined surface 203 of the slide member 201 (FIG. 95) to thereby advance the slide member 201 as well (FIG. 96). Further, when the lead tank 59 is pushed, the chuck ring 61 is contacted with the stepped portion 97 and, at the same time, the chuck body 204 is opened by the effect of the inclined surfaces so that, at this moment, the engagement to the succeeding lead B is released.

In other words, in this modification the two inclined surfaces are made to thereby positively open or dilate the chuck body so that a reliable operation of the chuck body is enhanced.

As described above, the present invention provides an improvement of the mechanical pencil which provides a favorable feeling of writing and an effective use of the writing lead.

What is claimed is:

1. A mechanical pencil comprising:

a tubular member having a front end and a rear end;

a slide member disposed at the front end of the tubular member for axial sliding movement therein, the slide member having a lead passageway for receiving a pencil lead; and a lead advancement mechanism mounted for axial movement within the tubular member and having a chuck body for undergoing advancing movement to advance the pencil lead through the lead passageway of the slide member and toward the front end of the tubular member and for undergoing retracting movement toward the rear end of the tubular member, the chuck body having a plurality of projections for engagement with the slide member so that the slide member undergoes retracting movement with the chuck body.

2. A mechanical pencil according to claim 1; wherein the chuck body has a first stepped portion and the slide member has a second stepped portion for engagement with the first stepped portion.

3. A mechanical pencil according to claim 1; wherein the slide member has a tubular portion and a window formed in the tubular portion; and wherein the projections of the chuck body are movably inserted in the window of the slide member.

4. A mechanical pencil according to claim 3; further comprising a chuck ring for opening/closing the chuck body, and a tubular body disposed at the front end of the tubular member and having a step portion for limiting movement of the chuck ring toward the front end of the tubular member.

5. A mechanical pencil according to claim 4; wherein a first distance between an end of the chuck ring and the step portion of the tubular body is smaller than a second distance between terminal ends of the projections of the chuck body and a front end of the window in the tubular portion of the slide member.

6. A mechanical pencil according to claim 5; wherein the first distance is smaller than the second distance by 0.1 mm.

7. A mechanical pencil according to claim 5; wherein the first distance is smaller than the second distance by an amount in the range of about 0.05 mm to about 1.0 mm.

8. A mechanical pencil comprising:

a tubular member having a front end and a rear end;

a slide member disposed at the front end of the tubular member for axial sliding movement therein, the slide member having a lead passageway for receiving a pencil lead; and a lead advancement mechanism mounted for axial movement within the tubular member and having a chuck body for undergoing advancing movement to advance the pencil lead through the lead passageway of the slide member and toward the front end of the tubular member and for undergoing retracting movement toward the rear end of the tubular member, the chuck body having a projection on an outer surface thereof, and the slide member having at a rear portion thereof an engagement hole for engagement with the projection of the chuck body so that the slide member undergoes retracting movement with the chuck body.

9. A mechanical pencil comprising:

a tubular member having a front end and a rear end;

a slide member disposed at the front end of the tubular member for axial sliding movement therein, the slide member having a lead passageway for receiving a pencil lead;

a lead advancement mechanism mounted for axial movement within the tubular member and having a chuck body for undergoing advancing movement to advance the pencil lead through the lead passageway of the slide member and toward the front end of the tubular member and for undergoing retracting movement toward the rear end of the tubular member, the slide member being engageable with the chuck body for retracting movement therewith;

a chuck ring for opening/closing the chuck body; and a tubular body surrounding the slide member with a gap disposed therebetween and having a step portion for limiting movement of the chuck ring toward the front end of the tubular member, the gap between the tubular body and the slide member being smaller than an engagement distance between the chuck body and the slide member.

10. A mechanical pencil comprising:

a tubular member having a front end and a rear end;

a slide member disposed at the front end of the tubular member for axial sliding movement therein in a first direction toward the front end of the tubular member and in a second direction toward the rear end of the tubular member, the slide member having a lead passageway for receiving a pencil lead; and a chuck member having a plurality of projections for engagement with the slide member, the chuck member being disposed in the tubular member for movement in the first direction to advance the pencil lead disposed in the lead passageway out of a front end of the slide member and for movement in the second direction together with the slide member while the projections of the chuck member and the slide member are engaged with one another.

11. A mechanical pencil according to claim 10; further comprising a biasing member disposed within the tubular member for biasing the chuck member toward the rear end of the tubular member.

12. A mechanical pencil according to claim 10; wherein the slide member has a tubular portion and a window formed in the tubular portion; and wherein the projections of the chuck member are movably inserted in the window of the slide member.

13. A mechanical pencil according to claim 12; further comprising a chuck ring for opening/closing the chuck member, and a tubular body disposed at the front end of the tubular member and having a step portion for limiting movement of the chuck ring toward the front end of the tubular member.

14. A mechanical pencil according to claim 13; wherein a first distance between an end of the chuck ring and the step portion of the tubular body is smaller than a second distance between terminal ends of the projections of the chuck member and a front end of the window in the tubular portion of the slide member.

15. A mechanical pencil according to claim 14; wherein the first distance is smaller than the second distance by 0.1 mm.

16. A mechanical pencil according to claim 14; wherein the first distance is smaller than the second distance by an amount in the range of about 0.05 mm to about 1.0 mm.

17. A mechanical pencil comprising:

a tubular member having a front end and a rear end;

a slide member disposed at the front end of the tubular member for axial sliding movement therein in a first direction toward the front end of the tubular member and in a second direction toward the rear end of the tubular member, the slide member having a lead passageway for receiving a pencil lead and an engagement hole at a rear portion thereof; and a chuck member having a projection on an outer surface thereof for engagement with the engagement hole of the slide member, the chuck member being disposed in the tubular member for movement in the first direction to advance the pencil lead disposed in the lead passageway out of a front end of the slide member and for movement in the second direction together with the slide member while the projection of the chuck member and the engagement hole of the slide member are engaged with one another.

18. A mechanical pencil comprising:

a tubular member having a front end and a rear end;

a slide member disposed at the front end of the tubular member for axial sliding movement therein in a first direction toward the front end of the tubular member and in a second direction toward the rear end of the tubular member, the slide member having a lead passageway for receiving a pencil lead;

a chuck member engageable with the slide member and disposed in the tubular member for movement in the first direction to advance the pencil lead disposed in the lead passageway out of a front end of the slide member and for movement in the second direction together with the slide member while the chuck member and the slide member are engaged with one another;

a chuck ring for opening/closing the chuck body; and a tubular body surrounding the slide member with a gap disposed therebetween and having a step portion for limiting movement of the chuck ring toward the front end of the tubular member, the gap between the tubular body and the slide member being smaller than an engagement distance between the chuck body and the slide member.

* * * * *